US005945617A

United States Patent [19]

Niitsuma

[11] Patent Number: 5,945,617

[45] Date of Patent: Aug. 31, 1999

[54] PIANO KEYBOARD DEVICE INCLUDING IMPROVED SUPPORT CHASSIS AND OPTIONAL ACTION SIMULATION MECHANISM, AND A METHOD OF ASSEMBLING THEREOF

[75] Inventor: Shinji Niitsuma, Hamamatsu, Japan

[73] Assignee: Kabushiki Kaisha Kawai Gakki Seisakusho, Hamamatsu, Japan

[21] Appl. No.: 08/956,249

[22] Filed: Oct. 22, 1997

[30] Foreign Application Priority Data

| | | | |
|---|---|---|---|
| Oct. 29, 1996 | [JP] | Japan | 8-286686 |
| Oct. 30, 1996 | [JP] | Japan | 8-288584 |
| Oct. 30, 1996 | [JP] | Japan | 8-288585 |
| Oct. 30, 1996 | [JP] | Japan | 8-288586 |
| Oct. 30, 1996 | [JP] | Japan | 8-288587 |
| Oct. 30, 1996 | [JP] | Japan | 8-288588 |
| Oct. 30, 1996 | [JP] | Japan | 8-288589 |

[51] Int. Cl.[6] ..... G10C 3/12

[52] U.S. Cl. ..... 84/423 R

[58] Field of Search ..... 84/423 R

[56] References Cited

U.S. PATENT DOCUMENTS

| | | | |
|---|---|---|---|
| 5,036,743 | 8/1991 | Yamaguchi et al. . | |
| 5,062,342 | 11/1991 | Nagatsuma . | |
| 5,545,839 | 8/1996 | Kawamura et al. | 84/171 |
| 5,565,636 | 10/1996 | Sugiyama | 84/171 |
| 5,571,983 | 11/1996 | Yamaguchi et al. . | |
| 5,741,995 | 4/1998 | Kawamura et al. | 84/171 X |

FOREIGN PATENT DOCUMENTS 9-190185 7/1997 Japan .

*Primary Examiner*—Jeffrey W. Donels
*Attorney, Agent, or Firm*—Davis and Bujold

[57] ABSTRACT

A plate-like member or rib 19 is extended in a back-to-front direction of a key 14. The height of a rear end of a flat portion 12 is regulated by an upper flange portion 21*c* and a lower flange portion 22 of the rib 19. A wippen 30 provided with a jack 44 is attached via a bearing member 33 for supporting a wippen swing axis 31 onto a chassis 11. A hammer 50 is attached via a center rail 60 provided with a bearing member 65 for supporting a hammer swing axis 51 onto the chassis 11. A bearing 16 for supporting a key support 15 is fixed to the chassis 11 with a flange portion 61 of the center rail 60 abutting on a rear L-shaped leg 18. A substantially L-shaped rail 67 is fixed with a screw on the center rail 60, which has on its top face a hammer cushion 68 for abutting a rest portion 52 of the hammer 50 and on its lower face a regulating felt for abutting on a hack tail 47. The wippen 30 has a long swing radius, and therefore a larger inertial moment by a weight 41, as compared with the jack 44 and the hammer 50. The rest portion 52, a butt portion 53 and a catcher portion 54 are provided on a continuous face of the hammer 50. A cushion material 56 constituted of a urethane foam layer for absorbing impact and an artificial leather layer providing slidability is placed on the continuous face. The key support 15 is provided between a sliding tape 32 of the wippen 30 and a jack axis 45.

38 Claims, 17 Drawing Sheets

PIANO KEYBOARD DEVICE INCLUDING IMPROVED SUPPORT CHASSIS AND OPTIONAL ACTION SIMULATION MECHANISM, AND A METHOD OF ASSEMBLING THEREOF

BACKGROUND OF THE INVENTION

The present invention relates to a keyboard device of an acoustic piano, an electronic piano or another keyboard instrument and an assembly method thereof, and particularly to though not exclusively a keyboard device provided with an action mechanism or a simulating action mechanism disposed on a chassis with a key support as a key swinging center disposed on a key bed and constituted of a wippen, a jack and a hammer, or to a keyboard device provided with a key support member including a key swing center and a rail member having a hammer swung in accordance with swinging of a key, both members being fixed on a chassis.

In a keyboard device heretofore used in an electronic piano, for example, as shown in FIG. 5, to secure a space of a key 514 (white key shown in FIG. 5) when depressed, a chassis 511 is provided with a flat portion 512 higher than a top face of a key bed 502. The flat portion 512 is provided with a key support 515, centering on which the key 514 is vertically swingably supported. Since the depressed key 514 is biased counterclockwise as shown in FIG. 5 by a spring 516 interconnecting a rear end of the key 514 and a rear end of the chassis 511, the key 514 returns to its original position when released.

Also, a base 528 is attached slightly lower than the chassis 511, and has thereon a push button 537 for detecting depression of the key 514. Two switches are disposed inside the push button 537: when the key 514 is depressed, at the initial stage one of the switches is depressed by an actuator 535 provided under the key 514, and when the key 514 is further depressed, the other switch is also depressed by the actuator 535. Key depressing timing and velocity can be obtained from a difference in switching on or off timing between the two switches.

In the keyboard device, the flat portion 512 of the chassis 511 is extended in a key arrangement direction (vertical to FIG. 5) and in a key back-to-forth direction (right to left in FIG. 5). The key support 515 of each of all the keys (e.g. 88 keys) is provided on the flat portion 512.

A rear end of the flat portion 512 of the chassis 511 is bent vertically downward via a first bent portion 511*a*, and further bent forward (or backward) via a second bent portion 511*b*. Therefore, the height of the rear end of the flat portion 512 is defined by the first and second bent portions 511*a* and 511*b*. A front end of the flat portion 512 of the chassis 511 is provided with a substantially U-shaped leg portion 513, which defines the height of the front end of the flat portion 512. The flat portion 512 of the chassis 511 is further provided with a reinforcing rib 519. The rib 519 is a leaf member extending in the key back-to-forth direction, and is provided with contact faces 519*a*, 519*b* for contacting an underside of the flat portion 512 of the chassis 511 and a reinforcing flange 519*c*.

In the aforementioned keyboard device, however, the accuracy in height of the key support 515 is influenced by the ending accuracy (accuracy in angle or in dimension of the height) of the first and second bent portions 511*a* and 511*b* of the chassis 511. The dimension (area) of the chassis 511 is so large that a large-sized metallic mold is necessary for bending the chassis 511 with a press or the like, and it is difficult to obtain a high accuracy.

On the other hand, for example in a keyboard device for use as an electronic keyboard instrument as shown in FIG. 6, to obtain the same key touch as in an acoustic piano, a simulating action mechanism is provided. Specifically, a hammer 650 is provided behind a rear end of a flat portion 612 of a chassis 611. An action lever 605 for transmitting action to the hammer 650 is passed from the underside of the key backward through a hole 606 connecting a rear end of the chassis 611 and a key bed 602, to transmit action of the key via a wippen 630, a jack 644 and a butt 649 to the hammer 650.

In the aforementioned keyboard device, a raised portion of the chassis 611 between a first bent portion 611*a* and a second bent portion 611*b*, the hole 606 for passing the action lever 605 needs to be provided. Further, the hole 606 is required for each hammer, thereby increasing cost. Also, the accuracy in height of a key support is influenced by the bending accuracy of the first and second bent portions 611*a* and 611*b* in the same manner as the keyboard device of FIG. 5. Therefore, it is not easy to obtain a high accuracy.

As a keyboard heretofore used in an electronic instrument, a wooden keyboard provided with a hammer or a plastic keyboard provided with a hammer is known. In this keyboard, the hammer is swung directly by a corresponding key. Therefore, a key letting-off effect cannot be obtained. There exists a problem that a touch of an acoustic piano cannot be realized.

To solve the problem and realize the touch of an acoustic piano, as shown in FIGS. 6, 8 or 16, an electronic instrument keyboard provided with a simulating action mechanism has been developed.

In the keyboard device shown in FIG. 6, when a key 614 is depressed to swing counterclockwise in the figure, an action lever 670 provided under the key 614 is also swung counterclockwise centering on a lever swing axis 671 on the chassis 611. Accompanying the swinging, the wippen 630 is swung clockwise arround a wippen swing axis 631 provided on a center rail 660, and the jack 644 pushes up the butt 649 of the simulating hammer 650. The simulating hammer 650 is then swung clockwise. After a jack tail 647 abuts on a regulating button 666, the jack 644 is rapidly swung counterclockwise to be disengaged from the butt 649. Then, the hammer 650 starts its inertial movement. This timing is a letting-off timing. Upon contact with a stopper 663, the hammer 650 swings back. In this manner, the keyboard device shown in FIG. 6 realizes a touch of an upright piano.

The key support 615 as a swing center of the key 614 is supported by a bearing 616 serving as a key support member. As shown in a partially enlarged view of FIG. 11, the bearing 616 has substantially L-shaped legs 618 thereunder. In attachment, after the L-shaped legs 618 are passed through inlets 617 in the chassis 611, the bearing 616 is slid toward the front of the key (to the left in FIG. 11). Thereby, the chassis 611 is placed between the L-shaped legs 618 and the underside of the bearing 616. Under this condition, a stopper piece 620 is fixed with a screw to abut on the rear end of the L-shaped legs 618. In this manner, the bearing 616 is fixed immobile on the chassis 611.

However, in this keyboard device, the stopper piece 620 is provided only for the bearing 616, which adds to cost. Also, attachment of the stopper piece 620 is additionally required, making complicated the operation.

Further, when the key 614 needs to be replaced, by removing the screw from the stopper piece 620, the stopper piece 620 has to be once removed.

In another keyboard device shown in FIG. 8, an action mechanism is the same as the action mechanism of an upright piano, except that a stopper is provided instead of a string. In the keyboard device, when depressed, a key 814 is swung counterclockwise centering on a key support 815. Accordingly, a wippen 830 is swung clockwise centering on a wippen swing axis 831 provided on a center rail 860, a jack 844 pushes up a butt 850*a* of a hammer 850, and the hammer 850 is then swung clockwise centering on a hammer swing axis 851 provided on the center rail 860. After a tail jack 847 abuts on a regulating button 866, the jack 844 is rapidly swung counterclockwise to be disengaged from the butt 850*a*. The hammer 850 in turn starts its inertial movement. This timing is a letting-off timing. Upon contact on a stopper 863, the hammer 850 sings back. In this way, the keyboard device of FIG. 8 realizes a touch of an upright piano.

However, a regulating felt on the regulating button 866 for regulating operation of the jack 844 is provided separately from a hammer cushion 868 for regulating an initial position of the hammer 850. Specifically, the former is provided on a regulating rail 861 fixed to the hammer rail 860, and the latter is provided on the hammer rail 869. Therefore, two separate members, the regulating rail 861 and the hammer rail 869 are necessary, thereby increasing cost remarkably.

On the other hand, to adjust the letting-off timing to a predetermined timing, the attachment accuracy of the regulating rail 861 provided with the regulating felt on the regulating button 866 needs to be increased. To set the initial position of the hammer 850 at a predetermined position, the attachment accuracy of the hammer rail 869 provided with the hammer cushion 868 needs to be increased. Therefore, the attachment accuracy of the two different members needs to be increased.

Also in the keyboard devices shown in FIGS. 6 and 8, a key unit U1 is provided separately from an action unit U2. Therefore, when the key unit U1 and the action unit U2 are assembled on the key bed, it is difficult to position these units U1 and U2. Also, after the units are attached onto the key bed, the height of the wippen needs to be adjusted with a capstan screw S for adjusting a key stroke.

In a keyboard device 701 for an electronic keyboard instrument provided with a simulating action mechanism shown in FIG. 16, a button type sensor 737 is provided under a key 714. The sensor 737 is provided with two switches inside. When the key 714 is depressed, one of the switches is depressed to issue an on signal, and when the key 714 is further depressed, the other switch is depressed to issue an on signal. Specifically, the sensor 737 detects respective timings at which the key 714 passes two predetermined positions while the key 714 moves from an initial position to a full stroke position. Based on the signals transmitted from the two switches of the sensor 737, a control device 705 obtains string striking information for producing string striking sound and sound stop information for stopping sound. Specifically, a velocity is obtained as sound intensity from a difference in on-timing between the switches, and sounding is stopped based on the off-timing of the switches.

In the keyboard device 701 for an electronic keyboard instrument, in the same manner as an acoustic piano, the key 714 abuts on a wippen 730 via a cushion C1, and a jack 744 abuts on a butt 750*a* of a hammer 750 via a cushion C2. Therefore, when the key 714 is depressed at a high speed, these cushions C1 and C2 is once resiliently deformed to store a certain degree of force. Thereafter, when the cushions C1 and C2 recover themselves, the wippen 730 and the hammer 750 act, thereby producing a strong piano sound. After the key 714 is depressed, there is a time lag before sound is produced. These characteristics are unique to an acoustic piano.

However, in the constitution where the key 714 pushes against the button type sensor 737, when the key 714 is rapidly depressed, the cushions C1, C2 are resiliently deformed from when one of the switches inside the sensor 737 is turned on until the other switch is turned on to resist pressure, which produces a resistance force. Therefore, a difference in on-timing between the switches becomes large, and a detected velocity (corresponding to the movement speed of the key) is decreased. An electronic sound is produced with intensity in accordance with the velocity. No strong sound is disadvantageously produced like an acoustic piano. Also, there arises no time lag until sound is produced like an acoustic piano. Specifically, in the keyboard device 701, the aforementioned characteristics peculiar to an acoustic piano cannot be reproduced precisely.

Therefore, there exists a desire for development of a keyboard device for an electronic piano which can reproduce the characteristics peculiar to an acoustic piano.

It is proposed in the keyboard device 701 that the generation of electronic sound is controlled in accordance with the movement speed of the hammer 750, not the movement speed of the key 714. The hammer 750 has the largest inertial moment in the swingable members of the action mechanism. After the key 714 is depressed, the hammer 750 most remarkably withstands before starting swinging. Therefore, by generating an electronic sound in accordance with the movement speed of the hammer 750, the aforementioned characteristics peculiar to an acoustic piano can be remarkably precisely reproduced. Specifically, for example, a sensor, the same as the button type sensor 737, to be depressed by the hammer 750 is provided for detecting the hammer 750 at two places between a standstill position and a simulating string-striking position of the hammer 750.

In the keyboard device 701, in the same manner as an acoustic piano, when the key 714 is depressed from its standstill position to its full-stroke position, the hammer 750 is swung from the standstill position (shown by a solid line in FIG. 16), midway let off and swung to the simulating string-striking position (shown by a two-dotted line in FIG. 16). Thereafter, the hammer 750 swings back. If the key is not released while the hammer 750 swings back, a catcher 754 is supported by a back check 743 at a backstop position (shown by a dotted line in FIG. 16). If the key is released, the hammer 750 is received by a hammer rail 768 at its standstill position.

Consequently, when generation of an electronic sound is controlled in accordance with the movement speed of the hammer 750, to precisely detect sound stop information, the sensor needs to be switched on or off precisely at the backstop position and the standstill position. Since the positions are close to each other, however, it is technically difficult to switch on or off the sensor precisely. To solve the problem, it is necessary to provide a separate switch to be turned on or off, for example, by the key for obtaining sound stop position. There arises a problem of increasing cost.

Also in the keyboard device 701, a hammer skin HS (i.e. the cushion C2) is placed on the butt 750*a* of the hammer 750 for absorbing shock of collision with the jack 744, inhibiting collision sound from generating and smoothly sliding on the jack 744. Also, a catcher skin CS is placed on the catcher 754 for absorbing shock arising when the catcher 754 is received by the back check 743 and inhibiting collision sound from generating.

However, since the hammer skin HS is a separate member from the catcher skin CS, a cushioning material has to be cut into the separate members to be placed, thereby increasing cost.

Further, when the key 714 is depressed, a capstan button 716 provided behind a key support 715 pushes up a felt F of the wippen 730. Thereby, the jack 744 is operated and the hammer 750 simulatively strikes a string. In this manner, the capstan button 716 has an important function. To provide the capstan button 716, the rear side behind the key support 715 of the key 714 requires a length. It is structurally difficult to shorten the key 714.

SUMMARY OF THE INVENTION

An object of the invention is to provide a keyboard device manufactured at a low cost and having a sufficiently increased accuracy in height of a key support.

Another object of the invention is to provide a keyboard device and an assembly method thereof for easily mounting the keyboard to a key bed with a high assembly accuracy.

Another object of the invention is to provide a keyboard device for preventing a key support member from being disengaged from a chassis without using an exclusive component.

Another object of the invention is to provide a keyboard device which can save cost and simplify mounting operation.

A further object of the invention is to provide an electronic keyboard device which can reproduce the characteristics peculiar to an acoustic piano precisely and can be manufactured at a low cost.

Another object of the invention is to provide a keyboard device which can inhibit collision sound in an action mechanism or a simulating action mechanism from generating at a low cost.

Yet another object of the invention is to shorten in a depth direction a keyboard device provided with an action mechanism or a simulating action mechanism.

To attain these or other objects, the present invention provides a keyboard device having a chassis positioned higher than a top face of a key bed and provided with a key support for swingably supporting a key and a plurality of ribs provided along a key arrangement direction for reinforcing the chassis and extending in a key back-to-forth direction. The ribs regulate an interval between the vicinity of the key support and the key bed in the chassis to be a predetermined interval.

In the keyboard device, the chassis is positioned higher than the top face of the key bed for swingably support a plurality of keys. The chassis have a flat plane including a key arrangement direction and a key back-to-forth direction, to define a height of the key support. Further, the ribs extending in the key back-to-forth direction are provided in the key arrangement direction for reinforcing the chassis. In the chassis, the interval between the vicinity of the key support and the key bed is regulated to the specified interval.

Here, the ribs are remarkably smaller than the chassis. Therefore, the ribs can be manufactured with a higher accuracy as compared with the bending of the large-sized chassis. Therefore, the interval between the vicinity of the key support and the key bed can be regulated to the specified interval with accuracy, and accuracy in height of the key support is increased. Further, by providing a plurality of ribs (e.g. 5 to 15 ribs for all the 88 keys) in the key arrangement direction, the chassis can be supported with a sufficient strength. Additionally, the ribs are already attached to the conventional keyboard chassis, thereby adding no cost.

As aforementioned, according to the keyboard device of the invention, accuracy in height of the key support can be increased at a low manufacture cost.

In the invention, each of the ribs comprising a metal plate having a first contact face for contacting the vicinity of the key support of the chassis and a second contact face for contacting the key bed. The first and second contact faces may be formed by bending the plate. In this case, the first and second contact faces of the rib can be formed by pressing, for example, with a small metallic mold. The accuracy of the rib depends on the accuracy of the metallic mold. However, since the small metallic mold is manufactured with high accuracy, the rib can have a sufficiently high accuracy. The height of the key support is determined by the interval between the first and second contact faces of the rib. Therefore, by increasing the accuracy of the rib, as a result, the accuracy in height of the key support can be increased.

Also in the invention, a reinforcing member having a configuration extending in the key arrangement direction is preferably formed integrally with the chassis, and the ribs are preferably fixed to the reinforcing member. The reinforcing member can be formed by bending the chassis or otherwise, or fixed to the chassis as a separate member extending in the key arrangement direction. If no reinforcing member is provided, when an obliquely downward force is applied from above, all the ribs are tilted and the chassis is deformed. By connecting the ribs to the reinforcing member, however, the chassis can resist against the force exerted obliquely downward from above. Consequently, the chassis is prevented from being deformed and the accuracy is advantageously prevented from being deviated.

In this case, the interval between a portion other than the vicinity of the key support of the chassis and the key bed may be regulated to the predetermined interval by the reinforcing member. Alternatively, the interval between the vicinity of the key support of the chassis and the key bed and the interval between the portion other than the vicinity of the key support of the chassis and the key bed may be regulated to the predetermined intervals, while the reinforcing member is fixed only to the ribs and not to the key bed. In either case, the aforementioned effect can be obtained.

Further in the invention, an open space can be provided between the rear end of the chassis and the key bed. In this case, a string striking porting or a simulating string striking portion (a hammer abutting on a stopper instead of actually striking a string) is provided behind the rear end of the chassis. An action transmitting member is extended between the underside of the key and the open space to the string striking portion or the simulating string striking portion, so that key action is transmitted to the string striking portion or the simulating string striking portion. Here, to provide the open space, for example, the rear end of the chassis is formed as a free end. Also, the action transmitting member can be a wippen in an action mechanism, a lever for transmitting action to the wippen or a lever formed integrally with the hammer.

In the conventional art, since the interval between the rear end of the chassis and the key bed is closed, a hole for passing the action transmitting member needs to be formed for each hammer. By providing the open space between the rear end of the chassis and the key bed as aforementioned, however, the hole does not have to be formed, which is cost effective. Also, when assembling a keyboard side and an action side including the hammer, the open space can be used, thereby enhancing operation efficiency.

The keyboard device of the invention can be applied either to an electronic keyboard instrument or an acoustic keyboard instrument. In the electronic keyboard instrument, if the height of the key support is not accurate, an adequate key depression data (key depression timing or velocity) cannot be obtained. Therefore, the keyboard device of the invention is useful especially in the electronic keyboard instrument.

According to the invention, in the keyboard device where the key support as a key swing center is provided on the chassis, a support member for supporting the action mechanism or the simulating action mechanism is provided on the chassis. In a method of assembling the keyboard device according to the invention, before the chassis is disposed on the key bed, the keyboard swingably supported by the key support and the action mechanism are fixed on the chassis, so that the keyboard and the action mechanism are positioned in a predetermined positional relationship.

The keyboard device of the invention can be applied to a keyboard instrument provided with the action mechanism constituted of a wippen, a jack, a hammer and the like for actually striking a string, or an electronic instrument provided with a simulating action mechanism for realizing a touch of an acoustic piano while not striking a string actually. Here, the simulating action mechanism is provided with a stopper for inhibiting action of the hammer, instead of the string of the action mechanism.

In the keyboard device, in addition to the key support, the action mechanism or the simulating action mechanism is also provided on the chassis. Specifically, a keyboard unit and an action unit (or a simulating action unit) are integrally formed on the chassis beforehand. Here, before the chassis is disposed on the key bed, both the units are fixed with accuracy on the chassis, so that the units are positioned in the predetermined positional relationship, in which when the key swings, in the action mechanism or the simulating action mechanism, the hammer strikes the string or a simulating hammer strikes a simulating string. In this case, intricate operation for positioning the units in the predetermined positional relationship on the key bed is not necessary. Therefore, the keyboard unit and the action unit can be easily mounted on the key bed. For the height of the keyboard and the action mechanism, by assembling the keyboard unit and the action unit with accuracy on the chassis beforehand, the height of the units is not changed when the assembled chassis is disposed on the key bed. Therefore, intricate operation for adjusting the height of each key with a capstan screw is not necessary.

As aforementioned, in the keyboard and its assembly method according to the invention, the mounting on the key bed can be performed easily and accurately.

Here, in the keyboard device of the invention, for example, the wippen is swingably supported on the chassis, the jack is swingably supported on the wippen, the hammer is swingably supported on a rail member and the rail member may be provided on the chassis. In the keyboard device, each member is beforehand positioned in a predetermined positional relationship, in which when the key swings, the wippen swings, the jack accordingly swings and moves, then the hammer accordingly swings. Therefore, a touch of an acoustic piano can be obtained. In this case, the hammer may actually strike a string, or collide against the stopper instead of striking the string (the hammer having the latter function is referred to as the simulating hammer).

In this case, the rail member is preferably provided in the vicinity of the rear end of the keyboard on the chassis. The reason is that the farther the rail member is behind the rear end of the keyboard, the larger the depth dimension of the keyboard device becomes, and by providing the rail member in the vicinity of the rear end of the keyboard on the chassis to shorten the depth dimension of the keyboard device, the keyboard device can be preferably formed in a compact structure.

Also, for the wippen, a wippen swing axis is swingably supported on a bearing provided on a chassis (i.e. the wippen is supported directly on the chassis). Alternatively, the wippen swing axis can be swingably supported on the rail member provided on the chassis (i.e. the wippen is indirectly supported on the chassis). However, in the latter case, the weight of the wippen is applied to the rail member, and the rail member has an increased load. There arises a need for strengthening the rail member. In this respect, the former constitution for directly supporting the wippen on the chassis is preferable.

Further, when the keyboard device of the invention is applied to an electronic keyboard instrument, a key depression sensor for detecting key depression information is preferably formed in the chassis. A positional relationship between the key depression detecting sensor and the keyboard is predetermined, and the key depression detecting sensor is positioned integrally on the chassis with accuracy beforehand. When the chassis is mounted on the key bed, the predetermined positional relationship is unchanged. In this case, there is no need of positioning the key depression detecting sensor and the keyboard unit separately on the key bed. As a result, the mounting on the key bed can be simplified.

Also, the invention provides a keyboard device in which a key support member including a swing center of a key and a rail member provided with a hammer swinging in response to swinging of the key are fixed on a chassis.

The key support member is inserted in an inlet provided in the chassis.

The rail member is fixed so that the key support member is not detached from the inlet in the chassis.

In the keyboard device, a component for fixing the key support member onto the chassis is not provided separately. The key support member is prevented from being detached from the chassis using the rail member provided with the hammer.

Therefore, according to the keyboard of the invention, component cost can be saved as compared with the case where the separate component is used. Also, by fixing the rail member to the chassis, the key support member can be effectively prevented from being detached from the chassis. There is no need of attaching the separate component.

Here, the key support member can be inserted in the inlet in the chassis with clearance, and can be engaged with a peripheral portion of the inlet. The rail member may be constituted to support the key support member inserted with clearance in the inlet and engaged with the peripheral portion of the inlet. The key support member is first inserted with clearance in the inlet, and is then engaged with the peripheral portion of the inlet. In this case, the key support member is engaged with the inlet without the rail member. The key support member can be temporarily fixed to the chassis. Therefore, operation efficiency is improved.

In the keyboard device of the invention, the key support member is preferably provided with a holding portion having a configuration including a substantially U-shaped configuration, and the holding portion is engaged so as to hold the peripheral portion of the inlet. The key support member provided with the holding portion is prevented from moving vertically relative to the chassis. For this purpose, the key support member is preferably provided with a plurality of the holding portions. If one holding portion is provided, the engaged key support is possibly tilted.

Also in the keyboard device of the invention, the key support member is preferably at the rear end of the keyboard. Usually, the rail member for supporting the swing axis of the hammer is attached behind the keyboard. Therefore, the key support member provided at the rear end of the keyboard, rather than around the middle of the keyboard, can be more easily fixed by the rail member.

Further in the keyboard device of the invention, the rail member is preferably fastened via a guide hole or a guide groove (hereinafter referred to as the guide hole or the like) provided therein by a fastening member (e.g. bolt and nut, screw and hole, vis screw or the like) on the chassis. By loosening the fastening member, the rail member can be slid and moved along the guide hole or the like between a position at which the key support member is prevented from being detached from the chassis and a position at which the key support member is permitted to be detached from the chassis. In case of replacement of the keyboard, the fastening member and the rail member are detached to detach the key support member from the chassis, which is an intricate operation. According to the invention, however, just by loosening the fastening member and sliding the rail member along the guide hole or the like, the key support member can be detached from the chassis. The operation efficiency is remarkably enhanced. The guide hole or the like includes an elliptical hole, an elongated hole, an elongated groove or the like.

Further, the keyboard device according to the invention can be provided with a wippen swingably supported on a chassis or a rail member, a jack swingably supported on a wippen, and a hammer swinging centering on a hammer swing axis provided on the rail member when the jack swings and moves. In operation, when the key swings, the wippen swings, the jack accordingly swings and moves, then the hammer swings centering on the hammer swing axis. Therefore, a touch of an acoustic piano can be obtained. In this case, the hammer may actually strike a string, or collide against a stopper instead of striking the string.

In this case, not only the keyboard but all the members constituting the action mechanism (the wippen, the hammer and the like) are mounted on the chassis (or a center rail provided on the chassis). When each member is accurately mounted on the chassis beforehand, there is no need of positioning each member on the key bed. Therefore, the mounting on the key bed can be simplified. Since the keyboard and the members constituting the action mechanism are accurately mounted on the chassis, they can be mounted on the key bed without changing their height. Therefore, intricate operation for adjusting the height of each key with a capstan screw is unnecessary.

The present invention also provides a keyboard device provided with a wippen swinging when a key swings, a jack swingably supported by the wippen for swinging and moving when the wippen swings and having its action regulated by a regulating member during acting, and a hammer.

The hammer is provided swingably between an initial position regulated by a hammer cushion member and a string striking position (or a simulating string striking position) regulated by a string (or a hammer stopper). When the jack swings and moves, the hammer starts swinging. When the action of the jack is regulated by the regulating member, the hammer is disengaged from the jack and starts inertial movement to reach the string striking position (or the simulating string striking position).

The regulating member and the hammer cushion member is provided on the same support member.

The keyboard device can be applied to a keyboard instrument provided with an action mechanism constituted of a wippen, a jack and a hammer for actually striking a string, or an electronic instrument provided with a simulating action mechanism for producing a touch of an acoustic piano without striking a string. Here, the simulating action mechanism is provided with a hammer stopper for inhibiting the hammer from acting instead of the string of the action mechanism.

In the keyboard device, when a key is depressed to swing, the wippen swings and the jack swingably supported by the wippen moves upward and swings, following swinging of the wippen. The jack moves upward to push up the hammer while swinging. The hammer starts swinging from the initial position. Subsequently, the jack is regulated to move apart from the hammer by the regulating member during its action. Therefore, the hammer starts inertial movement independent of the jack. This timing is a letting-off timing. Thereafter, the hammer continues inertial movement to reach the string striking position (or the simulating string striking position). At the string striking position, the hammer actually strikes a string, while at the simulating string striking position, the hammer collides against a hammer stopper provided instead of the string.

In the keyboard device the regulating member for regulating the action of the jack while the jack is acting and the hammer cushion member for regulating the initial position of the hammer are provided on the same support member. This is cost effective as compared with the case where these members are provided on separate support members.

Also, in order to determine the letting-off timing, the mounting accuracy of the regulating member requires to be high. To determine a key touch property applied to a finger depressing a key, the mounting accuracy of the hammer cushion member requires to be high. For this purpose, the regulating member and the hammer cushion member are provided on the support member by considering the letting-off timing and the initial position of the hammer beforehand. The aforementioned two requirements can be satisfied just by increasing the mounting accuracy of the support member. The mounting operation is simplified as compared with the case where two separate members (e.g. the regulating rail 861 and the hammer rail 869 in FIG. 8) are mounted.

Here, in the keyboard device of the invention, the support member is provided with two faces: one face is provided with the regulating member and the other face is provided with the hammer cushion member. In this case, since the support member is constituted simply, the mounting accuracy can be increased without increasing the manufacture cost of the support member.

Also in the keyboard device of the invention, the wippen, the hammer and the support member can be provided directly or via another member on the chassis supporting the key support of the keyboard. Specifically, since the action mechanism (or the simulating action mechanism) and the keyboard are provided on the same chassis, by mounting both with accuracy on the chassis beforehand, there is no need of positioning the action mechanism (or the simulating action mechanism) and the keyboard on the key bed as in the conventional art. The mounting on the key bed can be simplified.

Further in the keyboard device of the invention, the hammer and the support member are provided on a rail member connected to the chassis. The hammer is usually swingably supported by a center rail as the rail member. Here, to determined the initial position of the hammer, the positional relationship between the hammer cushion member and the hammer is important. For this, in order to easily position the hammer cushion member and the hammer, the support member provided with the hammer cushion member is preferably attached to the rail member provided with the hammer.

Still further in the keyboard device of the invention, the hammer stopper for stopping the inertial movement of the hammer is provided at the simulating string striking position. The hammer stopper can also be provided on the rail member. In this case, a separate component for supporting the hammer stopper is unnecessary. Therefore, cost can be saved. Additionally, when the hammer stopper is provided on the support member by predetermining the simulating string striking position, the accuracy required for the hammer stopper can be obtained just by increasing the mounting accuracy of the support member. The mounting operation is simplified as compared with the case where three separate members (e.g. the regulating rail 861, the hammer rail 869 and the hammer stop rail 862 in FIG. 8) are mounted.

The invention also provides a keyboard device for an electronic instrument provided with a wippen swinging when a key swings, a jack swingably supported by the wippen for swinging and moving when the wippen swings and having its action regulated during acting, a hammer starting swinging when the jack swings and moves, moving apart from the jack when the jack has its action regulated, and starting inertial movement until reaching the simulating string striking position, and an information detector for detecting information as a basis of performance information in response to swinging of the wippen.

The wippen has a larger inertial moment than the jack and the hammer.

The keyboard device can be applied to an electronic keyboard instrument provided with a simulating action mechanism for realizing a touch of an acoustic piano without actually striking a string. Here, the simulating action mechanism is provided with a hammer stopper for stopping the action of the hammer, instead of the string of the action mechanism. Also, the keyboard device of the invention can be applied to a keyboard instrument provided with both a string and a hammer stopper, in which a hammer can selectively collide against the string or the hammer stopper.

In operation of the keyboard device, when a key is depressed to swing, the wippen swings accordingly, and the jack swingably supported by the wippen then moves upward and swings. Since the jack moves upward to push up the hammer while swinging, the hammer starts swinging. Subsequently, during its action, the jack is regulated to move apart from the hammer. The hammer in turn starts inertial movement independent of the jack. This timing is a letting-off timing. Thereafter, the hammer continues inertial movement until reaching the simulating string striking position. Here, at the simulating string striking position, the hammer collides against the hammer stopper instead of the string.

In the keyboard device, when the key is depressed from its standstill position to the full-stroke position, the wippen swings from a position corresponding to the standstill position of the key (hereinafter referred to as the wippen initial position) to a position corresponding to the full-stroke position of the key (hereinafter referred to as the wippen swing position). Then, the information detector detects the information as a basis of the performance information in response to the swinging of the wippen.

The information detector may be constituted to determine first and second positions between the wippen initial position and the wippen swing position, and detect a timing when the wippen reaches the first position and a timing the wippen reaches the second position. Both timings correspond to the information as the basis of the performance information. For example, the velocity indicating sound intensity as one piece of performance information is obtained based on a difference between the timing when the wippen reaches the first position and the timing when the wippen reaches the second position. Also, the sound stop information as another piece of performance information is obtained based on a timing when the wippen again reaches the first position. In this manner, the information detector has a simple constitution just for detecting the timings when the wippen reaches the first and second positions.

In the invention, the wippen has a larger inertial moment than the jack and the hammer. Therefore, after the key is depressed at high speed, the wippen does not instantly start swinging. The wippen more remarkably withstands to some degree before starting swinging than the jack and the hammer. Since the jack and the hammer have a smaller inertial moment than the wippen, they start swinging immediately after the wippen swings. Therefore, in the invention, the wippen realizes the aforementioned characteristics peculiar to an acoustic piano, i.e. a relationship between a key touch when a key is depressed at high speed and a loudness of an accordingly produced electronic sound, and a time lag after the key is depressed until sound is produced.

Therefore, by detecting the basic information of the performance information in response to action of the wippen, the performance information for precisely reproducing the characteristics peculiar to an acoustic piano can be obtained. Therefore, when a player operates the keyboard device of the invention in the same manner when playing an acoustic piano, a sound is generated in the same manner as in the acoustic piano. The player does not feel difference.

Additionally, since each wippen acts corresponding to each key, sound stop information as a piece of performance information can also be precisely obtained based on the information detected by the information detector. In this respect, for example, when the basic information of the performance information is detected in response to action of the hammer, it is difficult to precisely obtain sound stop information, because each hammer does not act corresponding to each key. In this case, a separate detector is provided for the keyboard or the like, so that the sound stop information is obtained based on the information detected by the detector, which adds to cost. In the invention, however, no separate detector is necessary and no cost is added.

In the keyboard device of the invention, in order to make large the inertial moment of the wippen, the swing radius of the wippen is preferably larger than the swing radium of the jack or the hammer. Also, a weight is preferably attached to an end of the wippen to increase the inertial moment.

Also in the keyboard device according to the invention, in the same manner as an acoustic piano, the key preferably abuts on the wippen via a cushion material. The wippen formed of either wood or synthetic resin is resiliently deformed to some degree. Therefore, when the key swings at high speed, the wippen can store its force as aforementioned. When the cushion material is interposed between the key and the wippen, the cushion material is resiliently deformed in addition to resilient deformation of the wippen. Therefore, the force transmitted from the key can be easily stored in the wippen. In this case, the characteristics peculiar to an acoustic piano remarkably appear. Therefore, the invention is valuable in that the inertial moment of the wippen is maximized and the basic information of the performance information is detected in accordance with action of the wippen.

Further, when released, the key is given a force by the wippen receiving the weights of hammer and others such that the front end of the key is swung upward. The key is also held at its standstill position by the force. In this respect, considering that the key is effectively held at the standstill position, in the invention, the inertial moment of the wippen is preferably set higher than the inertial moment of the key. In this case, even if the jack and the wippen are made lighter and smaller to have a remarkably small inertial moment, the key can be effectively held at the standstill position.

The invention also provides a keyboard device provided with a wippen swinging when a key swings, a jack swingably supported by the wippen for swinging and moving when the wippen swings and having its action regulated during acting, a hammer starting swinging when the jack swings and moves, moving apart from the jack when the jack has its action regulated, and starting inertial movement until reaching a string striking (or a simulating string striking) position, and a back check for catching the hammer swinging back after reaching the string striking (or the simulating string striking) position.

The hammer is provided with a butt on which the jack can abut and a catcher portion caught by a back check portion of the wippen.

A shock absorbing member is provided for continuously covering the butt portion and the catcher portion.

The keyboard device can be applied both to an electronic instrument provided with a simulating action mechanism for providing a touch of an acoustic piano without actually striking a string, and to a keyboard instrument provided with an action mechanism constituted of a wippen, a jack and a hammer for actually striking a string. Here, the simulating action mechanism is provided with a hammer stopper for inhibiting the hammer from acting, instead of, for example, a string of the action mechanism.

In the keyboard device, when the key is depressed to swing, the wippen accordingly swings, and the jack swingably supported by the wippen moves upward and swings accompanying the swinging wippen. The jack moves upward to push up the hammer, while swinging. Then, the hammer starts swinging. During acting, the jack has its action regulated to move apart from the hammer. Therefore, the hammer starts inertial movement independently of the jack. This timing is a letting-off timing. Thereafter, the hammer continues inertial movement until reaching the string striking (or the simulating string striking) position. At the string striking position, the hammer actually strikes a string, while at the simulating string striking position, the hammer collides against the hammer stopper instead of, for example, the string. The hammer swinging back after reaching the string striking (or the simulating string striking) position is caught by the back check while the key is depressed, or returns to its initial position when the key is released.

Here, the keyboard device of the invention is provided with the shock absorbing member continuously covering the butt portion and the catcher portion of the hammer. The shock absorbing member prevents an impact sound from being generated while the jack and the butt portion of the hammer, or the back check and the catcher portion of the hammer are shifted from a non-contact condition to a contact condition.

Since the shock absorbing member is formed to continuously cover the butt portion and the catcher portion, the shock absorbing member needs not to be cut in pieces or placed individually, thereby reducing cost, as compared with the case where the butt portion and the catcher portion are individually covered. According to the keyboard device of the invention, an impact sound can be effectively prevented from being generated in the action mechanism or the simulating action mechanism at a low cost.

Here, considering the efficiency of operation for providing the shock absorbing member so as to continuously cover the butt portion and the catcher portion of the hammer, the butt portion and the catcher portion of the hammer are preferably provided on a continuous face. To easily realize such constitution, for example, the hammer is preferably molded as a configuration including the butt portion and the catcher portion.

In the keyboard device of the invention, a hammer cushion can be provided for regulating the initial position of the hammer. The hammer may be provided with a rest portion for abutting on the hammer cushion and the shock absorbing member may be formed so as to continuously cover the rest portion, the butt portion and the catcher portion. In this case, an impact sound is absorbed when the rest portion collides against the hammer cushion. Further, since the shock absorbing member continuously covers the butt portion, the catcher portion and the rest portion, cost can be reduced as aforementioned. In this case, considering the efficiency of operation in continuously providing the shock absorbing member, the butt portion, the catcher portion and the rest portion are preferably provided on a continuous face. To easily realize such constitution, for example, the hammer is preferably molded in a configuration including the butt portion, the catcher portion and the rest portion.

The invention further provides a keyboard device provided with a key swingably supported by a key support, a wippen swinging centering on a wippen axis when the key swings, a jack swingably supported by a jack axis provided on the wippen for swinging and moving when the wippen swings and having its action regulated during acting, and a hammer starting swinging when the jack swings and moves, moving apart from the jack when the jack has its action regulated, and starting inertial movement until reaching a string striking (or a simulating string striking) position.

The wippen has on one end a depressed portion depressed by the underside of the key and on the other end the jack axis rising when the depressed portion is depressed.

Between the depressed portion and the jack axis is provided the key support for swingably supporting the key.

The keyboard device can be applied both to an electronic instrument provided with a simulating action mechanism for providing a touch of an acoustic piano without actually striking a string and to a keyboard instrument provided with an action mechanism constituted of a wippen, a jack and a hammer for actually striking a string. Here, the simulating action mechanism is provided with a hammer stopper for inhibiting the hammer from acting, instead of, for example, a string of the action mechanism.

In the keyboard device, when the key is depressed to swing, the wippen accordingly swings centering on the wippen axis, and the jack swingably supported by the jack axis provided on the wippen moves upward and swings accompanying the swinging wippen. The jack moves upward to push up the hammer, while swinging. Then, the hammer starts swinging. During acting, the jack has its action regulated to move apart from the hammer. Therefore, the hammer starts inertial movement independently of the jack. This timing is a letting-off timing. Thereafter, the hammer continues inertial movement until reaching the string striking (or the simulating string striking) position. At the string striking position, the hammer actually strikes a string, while at the simulating string striking position, the hammer collides against, for example, the hammer stopper, instead of the string.

Here, the wippen is swingably supported by the wippen axis, and has on one end the depressed portion and on the other end the jack axis. The key support is provided between the depressed portion and the jack axis of the wippen. Therefore, when the key is depressed, the depressed portion provided on one end of the wippen is depressed by the underside of the key before the key support. Then, the wippen swings centering on the wippen axis, and the jack axis provided on the other end of the wippen rises. Thereby, the jack acts on the hammer, so that the hammer actually (or simulatingly) strikes a string.

Therefore, in the keyboard device of the invention, since the portion behind the key support of the key does not particularly function, the corresponding portion can be shortened. According to the invention, by reducing the length of the key, the length in the depth direction of the keyboard device can be advantageously shortened.

As aforementioned, in the invention since the portion behind the key support of the key does not especially function, the keyboard can have the portion behind the key support (or its vicinity) cut away. In this case, the keyboard device is shortened remarkably in a depth direction.

Further in the keyboard device of the invention, the wippen axis can be disposed between the key support and the jack axis (i.e. behind the key support). In this case, a space is required behind the key support for providing the wippen axis. Therefore, the keyboard device may be lengthened in the depth direction. To solve such disadvantage, the wippen axis is preferably provided between the key support of the key and the depressed portion of the wippen (i.e. before the key support).

BRIEF DESCRIPTION OF THE DRAWINGS

The invention will now be described, by way of example, with reference to the following drawings, in which.

DETAILED DESCRIPTION OF PREFERRED EMBODIMENTS

Embodiments of the present invention are now described with reference to accompanying drawings. The invention is not restricted to following embodiments, and various modifications and alterations are possible within the scope of the appended claims.

First Embodiment

Figure 1:
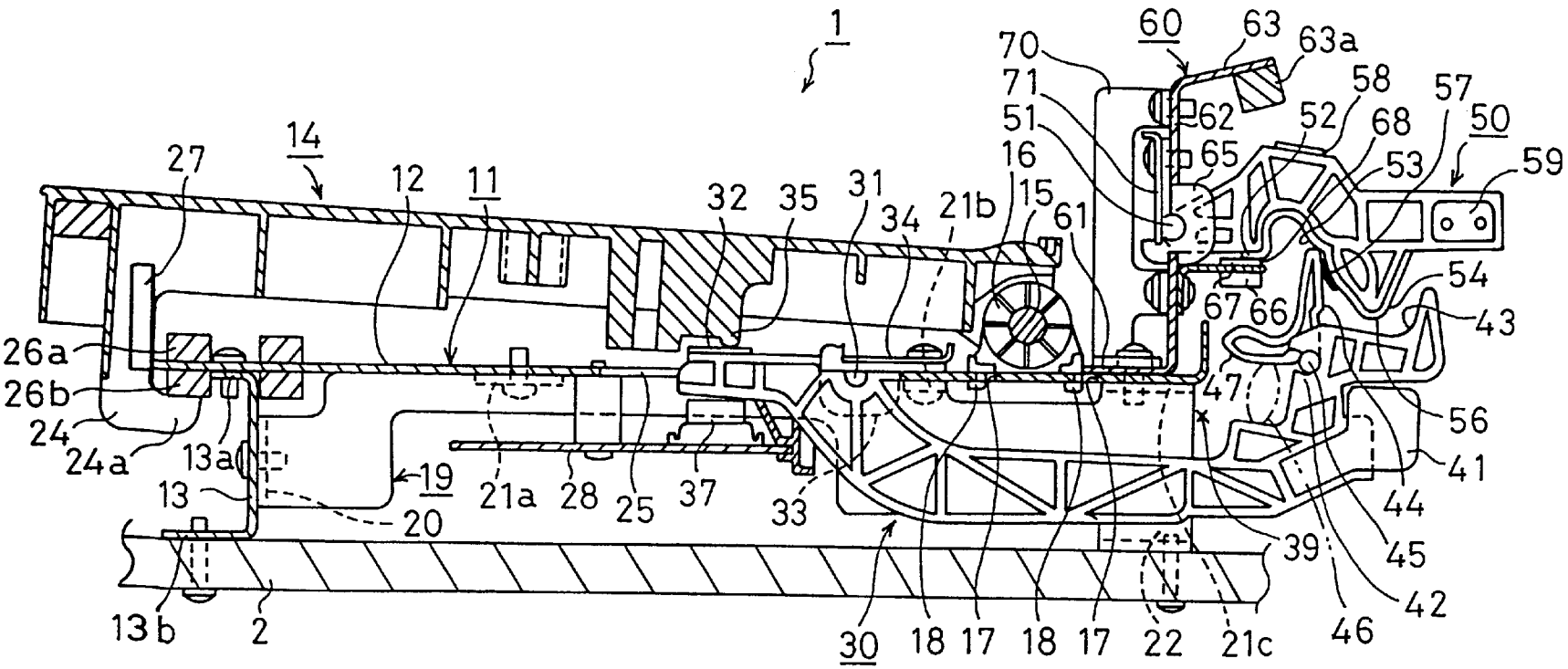
FIG. 1 is a sectional view showing a keyboard device of a first embodiment in which a key is released, according to the present invention.
Figure 2:
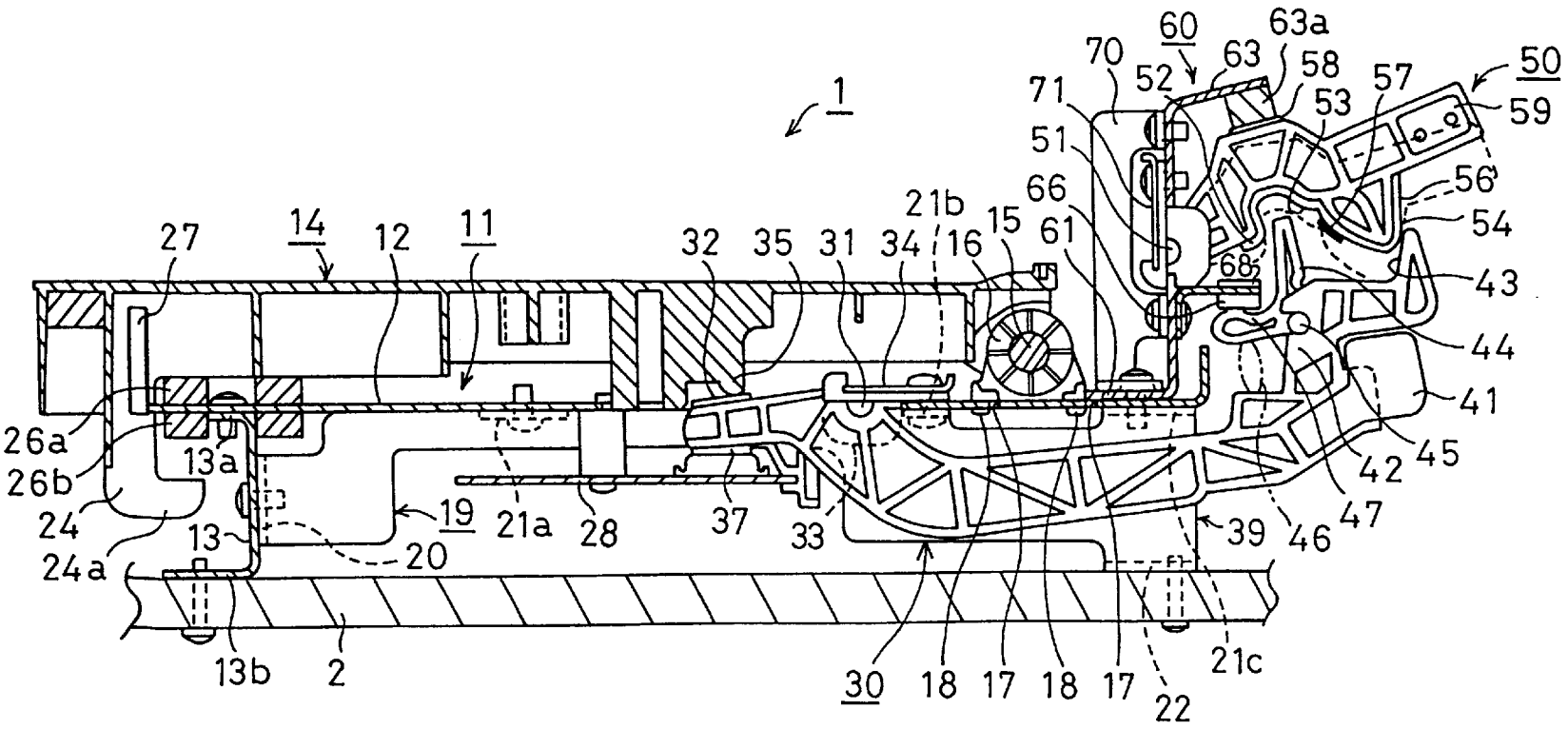
FIG. 2 is a sectional view showing the keyboard device of the first embodiment in a simulating string striking condition.

FIG. 1 is a sectional view of a keyboard device according to the first embodiment, in which a key is released. FIG. 2 is a sectional view showing the keyboard device in a simulating string striking condition. FIGS. 1 and 2 illustrate a white key. A black key is the same as the white key except the constitution of the key itself.

A keyboard device 1 for use in an electronic keyboard instrument is provided mainly with a chassis 11, a rib 19, a key 14, a wippen 30, a center rail 60, a hammer 50 and the like. Here, the wippen 30 is similar to, but not the same as the action lever 605 shown in FIG. 6. Specifically, the action lever 605 of FIG. 6 transmits a key action to the wippen, while in the embodiment the wippen 30 only has a function of wippen itself The chassis 11 is provided with a flat portion 12 positioned higher than a top face of a key bed 2, and a leg portion 13 fixed as a separate component to a front end of the flat portion 12. The flat portion 12 is a plane including an arrangement direction of keys 14 (vertical to a sheet surface of FIGS. 1 and 2, the same in the following) and a back-to-forth direction of keys 14 (right to left direction in FIGS. 1 and 2, the same in the following). On a rear end of the flat portion 12 a bearing is fixed 16 for supporting a key support 15 of each of all the 88 keys.

The bearing 16 has substantially L-shaped legs 18 thereunder. After the L-shaped legs 18 are inserted in holes 17, by sliding the bearing 16 toward the front of the key (to the left in FIGS. 1 and 2), the flat portion 12 is held between the L-shaped legs 18 and the underside of the bearing 16. In this condition, by fixing a front end of a flange portion 61 of the center rail 60 to abut on a rear end of one of the L-shaped legs 18 (the rear leg, i.e. the right L-shaped leg 18 as seen in FIG. 1), the bearing 16 is fixed immobile on the flat portion 12 of the chassis 11. In this case, the bearing 16 is precisely positioned on the chassis 11.

On the flat portion 12, an opening 25 is provided on each key for vertically passing a front end of the wippen 30. Further, the rear end of the flat portion 12 is a free end slightly bent upward. Therefore, an open space 39 is provided between the rear end of the flat portion 12 and the key bed 2.

The leg portion 13 of the chassis 11 extends in the arrangement direction of the keys 14 and has a substantially U-shaped cross section. An upper flange portion 13*a* of the leg potion 13 is fixed with a screw on the flat portion 12, and a lower flange portion 13*b* is fixed with a screw on the key bed 2. Therefore, the height of the front end of the flat portion 12 is defined by the leg portion 13.

The rib 19 is a plate member extending in the back-to-forth direction of the key 14. A front flange portion 20 is fixed with a screw on the leg portion 13 of the chassis, upper flange portions 21*a*, 21*b* and 21*c* are fixed with a screw on the flat portion 12 of the chassis, and a lower flange portion 22 is fixed with a screw on the key bed 2.

The height of the rear end of the flat portion 12 (i.e. the vicinity of the key support 15) is defined by the upper flange portion 21*c* (a first contact face in the invention) and the lower flange portion 22 (a second contact face in the invention) opposed to the upper flange portion 21*c*. The rib 19 is formed by pressing a metallic plate material in a metallic mold, and each of the flange portions 20–22 is formed by bending the material in the metallic mold. Thereby, the manufacturing cost of the rib 19 can be reduced, and the accuracy of the rib 19 can be high since it is dependent on a small-sized metallic mold. Therefore, the height of the key support 15, i.e. the height of the rear end of the flat portion 12 can be defined with sufficient accuracy.

The key 14 (white key in the embodiment) is formed in a hollow body of synthetic resin provided with several reinforcing ribs. The rear end of the key 14 is swingably attached to the key support 15. Therefore, the tip of the key 14 can vertically swing centering on the key support 15. From the tip of the key 14, a hook-shaped arm 24 extends downward. The hook-shaped arm 24 has a hook portion 24*a* bent toward the key support 15.

When the key 14 is not depressed, as shown in FIG. 1, the hook portion 24*a* of the hook-shaped arm 24 abuts on a longitudinal felt 26*b* provided on the underside of the front end of the flat portion 12 of the chassis 11. When the key 14 is depressed, as shown in FIG. 2, the underside of the front end of the key 14 abuts on the longitudinal felt 26*a* provided on a top face of the front end of the flat portion 12 of the chassis 11. Further, in a hollow portion of the front end of the key 14 a key guide portion 27 is inserted and is directed upward at the front end of the flat portion 12 of the chassis 11. The key guide portion 27 guides a tip of the key 14 when the key is operated, while preventing the tip from horizontally oscillating.

Below the key 14, the wippen 30 (action transmitting member of the invention) is swingably supported by a substantially U-shaped bearing member 33 on a wippen swing axis 31 of the chassis 11. The bearing member 33 is provided with a bearing member fixing plate 34 for covering the wippen swing axis 31 from above. The bearing member fixing plate 34 and the bearing member 33 are fixed with the same screw like cantilevers on the chassis 11. The wippen swing axis 31 is prevented by the bearing member fixing plate 34 from being disengaged from the bearing member 33. Further, the bearing member 33 is precisely positioned and attached on the chassis 11.

A front end of the wippen 30 is disposed to be vertically moved above and below the chassis 11 via the opening 25 of the chassis 11 when the wippen 30 swings centering on the wippen swing axis 31. A top face of the front end of the wippen 30 is provided with a sliding tape 32 (cushion material of the invention) having a small surface frictional resistance. The sliding tape 32 is in contact with a tip of an actuator 35 protruded from the underside of the key 14. The sliding tape 32 is constituted of two layers: an urethane foam layer for absorbing impact and an artificial leather surface layer for providing slidability.

Figure 15:
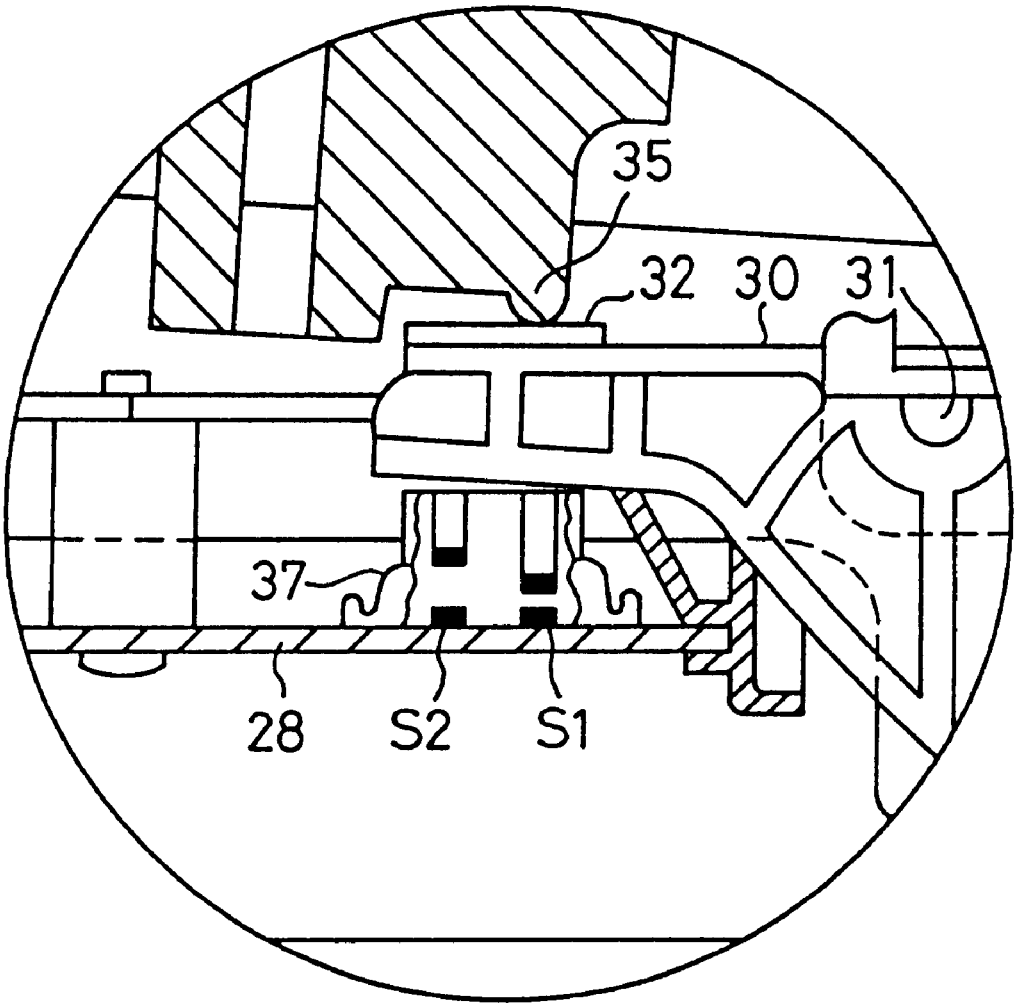
FIG. 15 is a partial enlarged view of FIG. 1.
Figure 16:
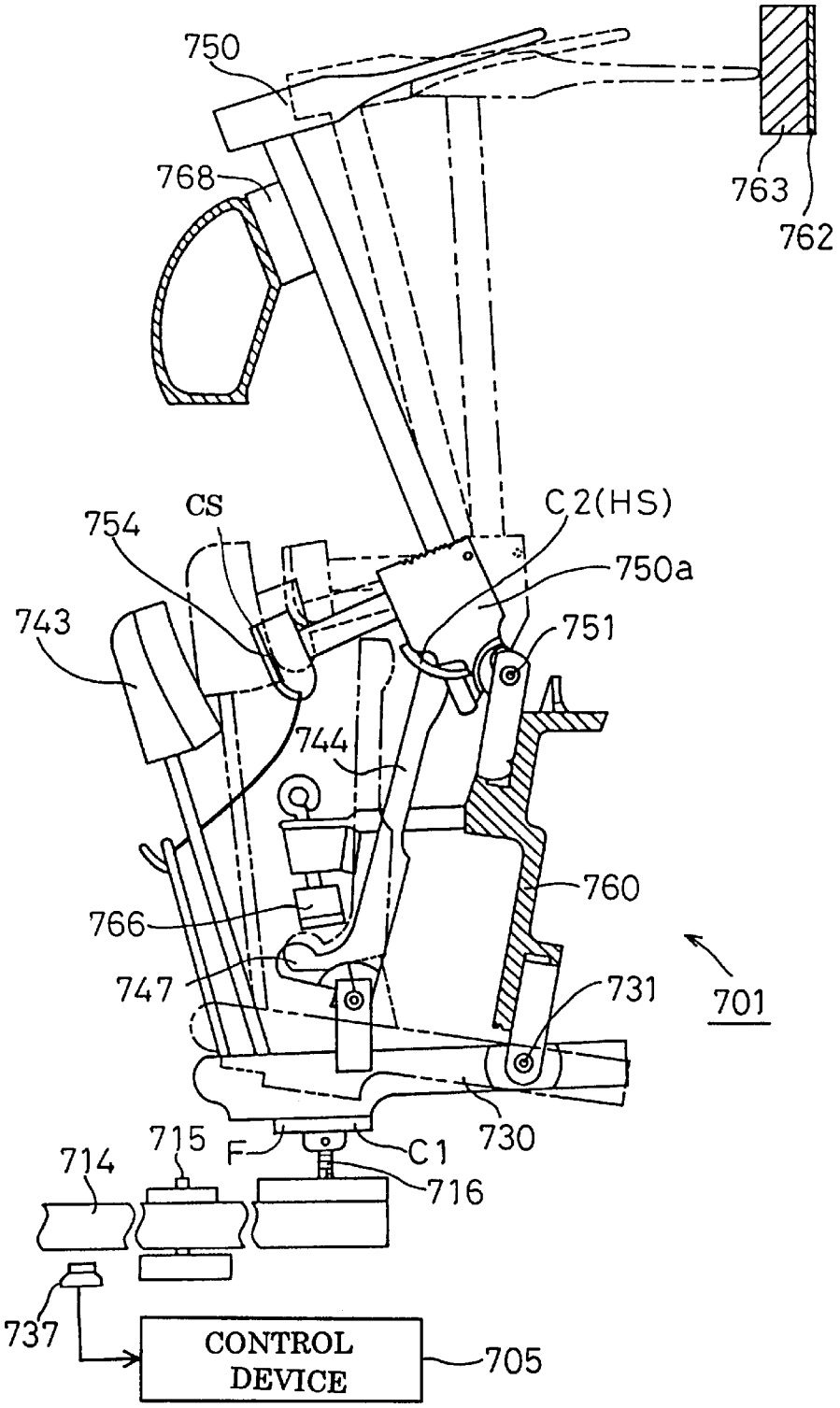
FIG. 16 PRIOR ART
FIG. 16 is a sectional view of a prior-art keyboard device.

Below the front end of the wippen 30, a base 28 extending in the key arrangement direction is attached on the chassis 11 with a predetermined interval from the flat portion 12 of the chassis 11. On the base 28, a key depression detecting sensor 37 is provided opposite to the wippen 30 provided for each of all the 88 keys. As shown in FIG. 15, the key depression detecting sensor 37 has inside two switches S1 and S2. When the key 14 at the initial position is depressed to cause the actuator 35 to depress the front end of the wippen 30, first one switch S1 turns on. When the key 14 is further depressed, the other switch S2 turns on. Subsequently, the key 14 reaches its full-stroke position. According to the invention, the wippen 30 takes a first position when the switch S1 turns on, and takes a second position when the switch S2 turns on. From on and off-timings of the switches S1 and S2 and a difference in timings between the switches, key depression/release timings and velocities can be obtained, based on which a sound is produced from an electronic sound source under control of an electronic control circuit (not shown) with a musical interval corresponding to the position of the key and sound intensity corresponding to the key depression velocity at a timing corresponding to the key depression timing, and sounding is stopped at the key release timing. Further, the key depression detecting sensor 37 is precisely positioned on the base 28 by considering the positional relationship with the key 14.

On a rear end of the wippen 30, a bearing portion 42 for supporting a jack rotation axis 45 and a back check 43 for receiving the swung back hammer 50 are provided integrally with accuracy.

The rear end of the wippen 30 is provided with a weight 41, so that the inertial moment of the wippen 30 is larger than that of a jack 44 and the hammer 50. Also, a swing radius (i.e. a length between the wippen swing axis 31 and the weight 41) of the wippen 30 is longer than that of the jack 44 and the hammer 50. In the embodiment, to lengthen the swing radius of the wippen 30, the rear end of the wippen is passed through the open space 39 between the rear end of the flat portion 12 of the chassis 11 and the key bed 2 to reach behind the rear end of the flat portion 12 of the chassis 11.

The jack 44 has a substantially L-shaped cross section, and the jack rotation axis 45 is provided on a bent portion of the L-shaped cross section. A jack tail 47 is connected with the wippen 30 via a compression coil spring 46.

The center rail 60 is extended in the key arrangement direction, and provided with a rising portion 62 extending substantially vertical to the flat portion 12 of the chassis 11, the flange portion 61 bent from a lower end of the rising portion 62 toward the front of the key 14 and a stop rail portion 63 extending obliquely upward from an upper end of the rising portion 62 to the rear side. The center rail 60 is positioned with accuracy on the flat portion 12 of the chassis 11 and fixed with a screw. A front end of the flange portion 61 of the center rail 60 is fixed abutting on the rear L-shaped leg 18, so that the rear L-shaped leg 18 of the bearing 16 for supporting the key support 15 is prevented from sliding in the corresponding hole 17.

On the rising portion 62 of the center rail 60, a rail 67 having a substantially L-shaped cross section is extended along the key arrangement direction and fixed with a screw. On a top face of the rail 67 provided is a hammer cushion 68 for abutting on a rest portion 52 of the hammer 50 while the key is released. The underside of the rail 67 is provided with a regulating felt 66 for abutting on the jack tail 47. Further, on the underside of the stop rail portion 63 provided is a stop felt 63*a* extending in the key arrangement direction. In this manner, since the hammer cushion 68 and the regulating felt 66 are provided on the rail 67, cost can be reduced as compared with the case where they are provided on separate rails. Further, the rail 67, the regulating felt 66 and the hammer cushion 68 are positioned with accuracy before fixed.

Further, the center rail 60 is provided with an action rib 70 for reinforcement. The action rib 70 is fixed at two places with a screw on the rising portion 62 of the center rail 60, and at one place with a screw on the flange portion 61 of the center rail 60.

A hammer swing axis 51 provided on the front end of the hammer 50 is swingably supported by a bearing member 65 which has a substantially U-shaped cross section and is inserted in a square hole in the rising portion 62 of the center rail 60. The bearing member 65 is provided with a bearing member fixing plate 71 for covering the hammer swing axis 51. The bearing member fixing plate 71 and the bearing member 65 are fixed with a screw like cantilevers to the center rail 60. The hammer swing axis 51 is prevented by the bearing member fixing plate 71 from being disengaged from the bearing member 65. Further, the bearing member 65 is positioned with accuracy on the center rail 60 before attached thereto.

The underside of the hammer 50 is provided with the rest portion 52 for abutting on the hammer cushion 68, a butt portion 53 having a substantially S-shaped cross section on or from which the tip of the jack 44 abuts or moves apart, and a catcher portion 54 for abutting on the back check 43 of the wippen 30. The hammer 50 is molded of synthetic resin into a configuration including the rest portion 52, the butt portion 53 and the catcher portion 54. Therefore, the rest portion 52, the butt portion 53 and the catcher portion 54 are provided on a continuous plane. On the hammer 50, a cushion material 56 (the shock absorbing member of the invention) is continuously placed for covering the rest portion 52, the butt portion 53 an the catcher portion 54. The cushion material 56 is constituted of two layers: an urethane foam layer for absorbing impact and an artificial leather surface layer for providing slidability. A portion of the cushion material 56 on which the tip of the jack 44 abuts while the key is not depressed is provided with a cushion material 57 for absorbing an impact noise generated when the jack 44 is returned or biased by the compression coil spring 46 to abut on the cushion material 56 of the hammer 50 after the key is released.

When the hammer 50 swings counterclockwise in FIG. 1 centering on the hammer swing axis 51, a simulating string striking portion 58 on the top face of the hammer 50 collides against the stop felt 63*a* provided on the center rail 60. The simulating string striking portion 58 is provided with a cushion material for absorbing an impact noise generated when the hammer 50 collides against the stop felt 63*a*.

The rear end of the hammer 50 is provided with a weight 59 by considering the gravity center of a hammer and the swinging back of the hammer in an action mechanism of an acoustic piano. The inertial moment of the hammer 50 is set smaller than that of the wippen 30.

The wippen 30, the jack 44 and the hammer 50 are all formed of synthetic resin, and are not distorted over a long time period.

In the keyboard device 1 having the aforementioned constitution, when the key is not depressed, as shown in FIG. 1, the weight 41 and the like of the wippen 30 exerts the moment of a clockwise force on the front end of the wippen 30 and also on the actuator 35, so that the key 14 tries to swing clockwise. However, the key 14 is inhibited from swinging clockwise because the hook portion 24*a* of the hook-shaped arm 24 abuts on the longitudinal felt 26*b*.

When a player depresses the key 14, the key 14 swings centering on the key support 15 counterclockwise in FIG. 1. Thereby, the front end of the wippen 30 is depressed by the actuator 35, and the wippen 30 swings counterclockwise centering on the wippen swing axis 31. The underside of the front end of the wippen 30 depresses the key depression detecting sensor 37, while the rear end of the wippen 30 swings upward. Accompanying the swinging of the wippen 30, the jack 44 rises to push up the butt portion 53 of the hammer 50, while swinging counterclockwise relative to the wippen 30. Subsequently, after the jack tail 47 of the jack 44 abuts on the regulating felt 66, the jack 44 immediately swings counterclockwise on a support of abutting place between the jack tail 47 and the regulating felt 66. The tip of the jack 44 moves apart from the butt portion 53 of the hammer 50, which is a letting-off action. Therefore, in the simulating action mechanism, the letting-off action is given in the same manner as in the action mechanism. In this case, since the jack 44 abuts on the butt portion 53 via the cushion material 56, no unusual noise is generated. Further, the jack 44 easily slides on the hammer 50.

After the letting-off action, the hammer 50 starts inertial movement while continuing to swing counterclockwise. Subsequently, the simulating string striking portion 58 of the hammer 50 collides against the stop felt 63*a*, as shown in FIG. 2. Thereby, the inertial movement of the hammer 50 is inhibited. Subsequently, the hammer 50 swings in reverse or clockwise.

When the hammer 50 thus swings back, if the key 14 is released, the rest portion 52 of the hammer 50 abuts on the hammer cushion 68. In this condition, the hammer 50 is stopped at its initial position (refer to FIG. 1). Since the rest portion 52 is covered with the cushion material 56, no impact noise is generated even when the rest portion 52 collides against the hammer cushion 68. On the other hand, when the hammer 50 swings back, if the key 14 continues to be depressed, the catcher portion 54 of the hammer 50 is received at a back stop position (shown by a dotted line in FIG. 2) by the back check 43 provided on the rear end of the wippen 30, before the rest portion 52 of the hammer 50 abuts on the hammer cushion 68. In this case, since the catcher portion 54 is covered with the cushion material 56, no impact noise of the catcher portion 54 colliding against the back check 43 is generated.

Figure 9:
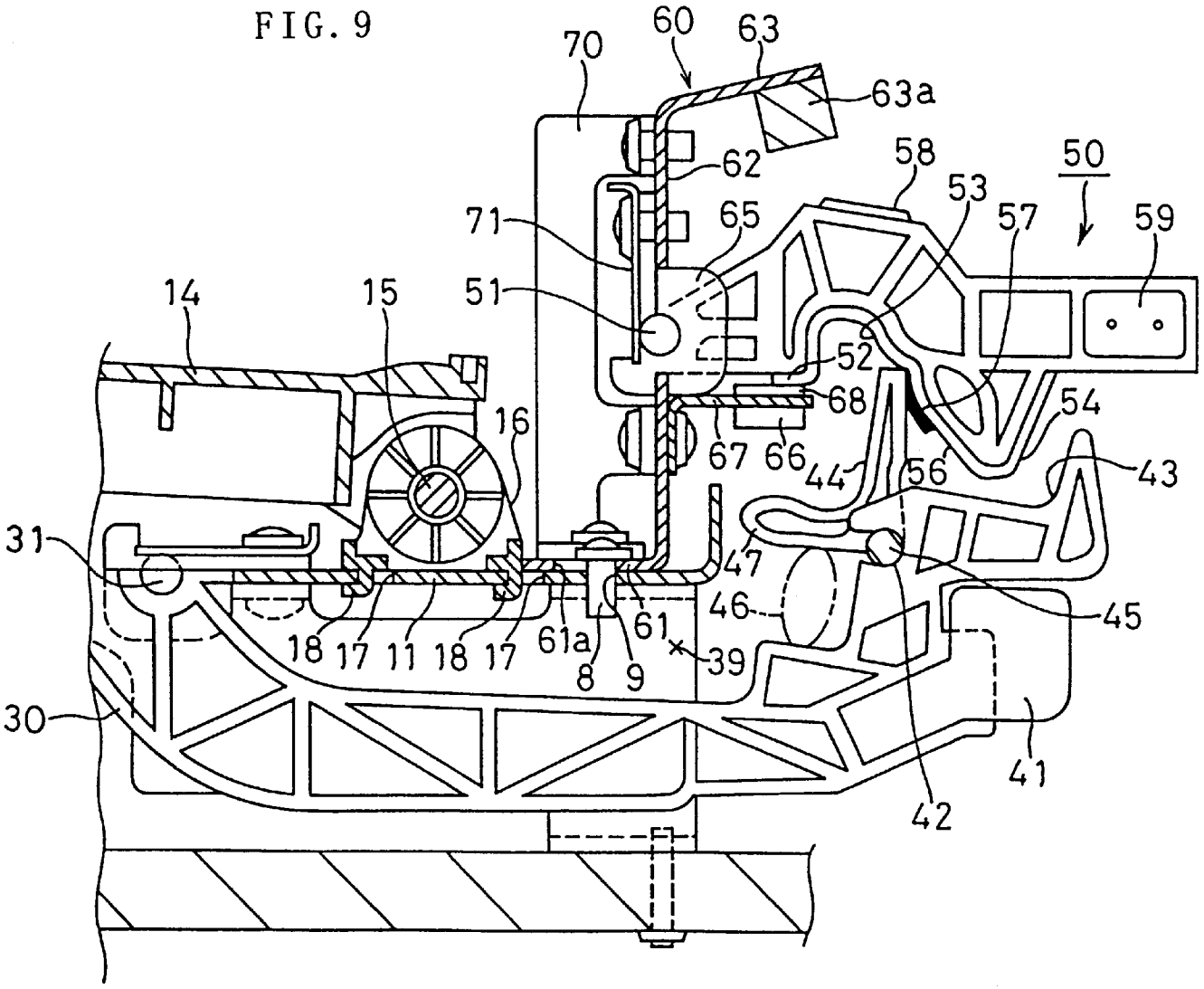
FIG. 9 is a partial enlarged view of FIG. 1.
Figure 10:
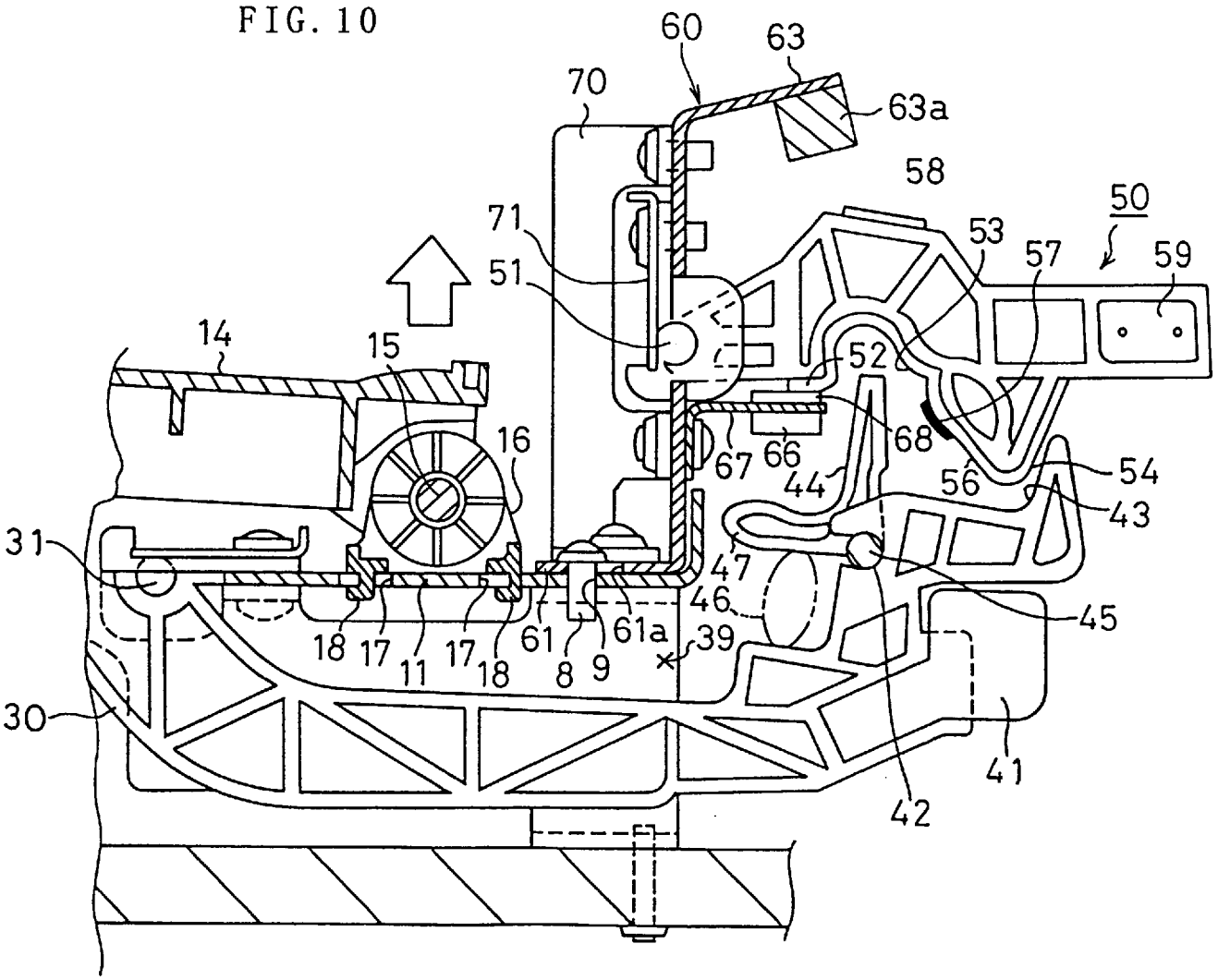
FIG. 10 is an explanatory view showing how to disassemble a keyboard in the keyboard device of the first embodiment.
Figure 11:
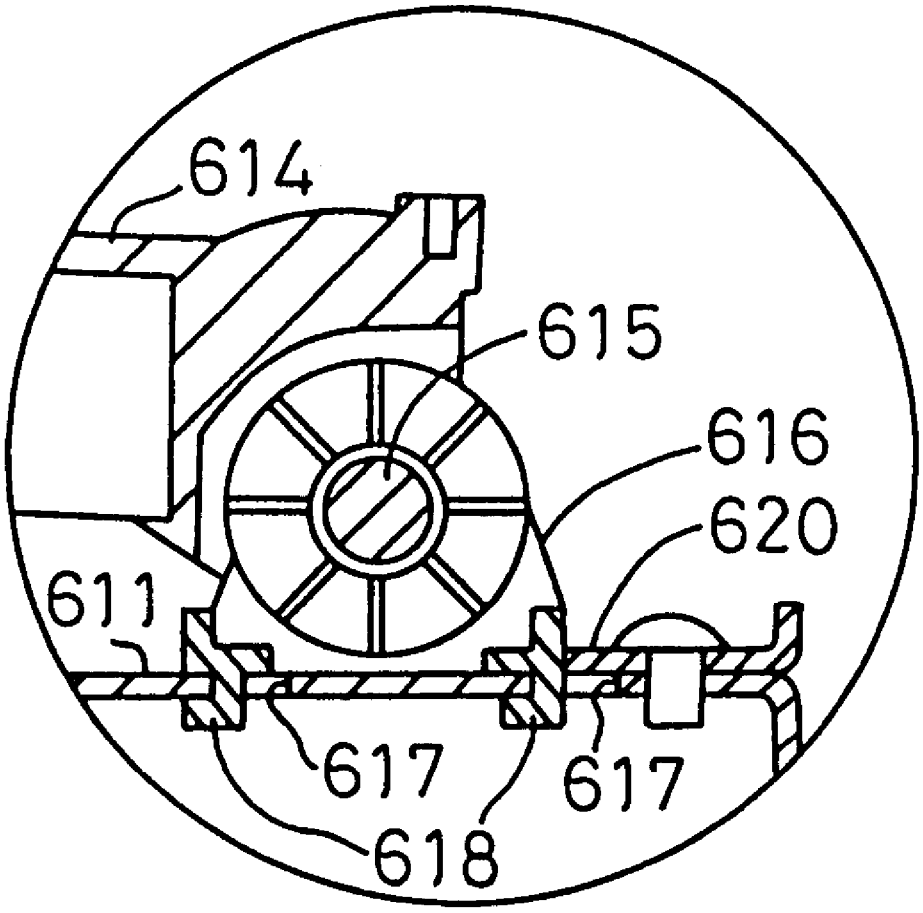
FIG. 11 PRIOR ART
FIG. 11 is a partial enlarged view of the prior-art keyboard device.

The case when the key 14 having some defect needs to be disassembled is described referring to FIGS. 9 and 10. In this case, first by slightly loosening a screw 8, the center rail 60 is slid along an elongated hole 61*a* formed in the key back-to-forth direction toward the rear side (to the right in FIGS. 9 and 10). Thereby, the center rail 60 is positioned at a position (refer to FIG. 10) at which the bearing 16 can be detached from the hole 17. Subsequently, the bearing 16 is moved in the hole 17 toward the rear side, to release the L-shaped leg 18 from the hole 17, and is pulled upward (refer to FIG. 10). In this manner, according to the embodiment, the bearing 16 can be pulled up or removed to disassemble the key 14, without removing the screw 8 and the center rail 60.

The center rail 60 is extended in the key arrangement direction and provided, for example, for each octave. The screw 8 can be provided for each key 14. However, the screw 8 is preferably provided for several keys for operation efficiency, because fewer screws need to be loosened when removing the key 14.

The case when a player depresses the key 14 at a high speed is now described. When the key 14 is quickly depressed, the key 14 swings counterclockwise in FIG. 1 centering on the key support 15. Thereby, the sliding tape 32 of the wippen 30 is depressed by the actuator 35. Since the wippen 30 has a large inertial moment, the sliding tape 32 is resiliently deformed and the wippen 30 itself is slightly deformed, to store the pressure of the actuator 35. Therefore, the wippen 30 does not start swinging immediately.

Subsequently, in addition to the pressure of the actuator 35, the restoring force of the deformed sliding tape 32 and the deformed wippen 30 is exerted, so that the wippen 30 starts swinging with force. Accompanying the forced swinging of the wippen 30, the jack 44, having an inertial moment smaller than that of the wippen 30, immediately slides pushing up the hammer 50. As the jack 44 slides, the hammer 50, having an inertial moment smaller than that of the wippen 30, immediately starts swinging, is let off from the jack 44 and reaches the simulating string striking position. Therefore, the characteristics peculiar to an acoustic piano, i.e. a touch of a quickly depressed key, its relationship with the loudness of a produced electronic sound and a time lag before generating the sound can be realized by the wippen 30 in the embodiment.

The key depression detecting sensor 37 stays at its initial condition (with the switches S1 and S2 off), before the wippen 30 starts swinging. When the wippen 30 starts swinging with force and reaches the first position, the switch S1 turns on. Subsequently, when the wippen 30 reaches the second position, the other switch S2 turns on. Subsequently, after the hammer 50 swings back, if the key is depressed, the wippen 30 is at a position (wippen swing position) shown in FIG. 2, and both the switches S1 and S2 are on. If the key is released, the wippen 30 is at a position shown in FIG. 1 (wippen initial position), and both the switches S1 and S2 are off.

Except that the hammer 50 does not strike a string, the function of the simulating action mechanism of the embodiment is the same as the action mechanism of an acoustic piano. Therefore, a player can obtain from the key 14 a touch almost the same as a touch of an acoustic piano.

When a player depresses the key, the underside of the front end of the wippen 30 contacts the key depression detecting sensor 37, turning on or off the two switches in the sensor 37. Therefore, the key depression timing and velocity can be detected. Based on the detection, a musical sound can be generated from an electronic sound source under control of an electronic control circuit (not shown) at a timing corresponding to the key depression timing with a musical interval corresponding to the depressed key and an intensity corresponding to the key depression velocity.

According to the aforementioned first embodiment, the following effects can be obtained.

(1) In the keyboard device 1 of the invention, the small-sized rib 19 regulates an interval between the rear end of the flat portion 12 (i.e. the vicinity of the key support 15) and the key bed 2 to a predetermined interval. Since the upper flange portion 21*c* and the lower flange portion 22 of the rib 19 can be integrally formed by pressing in a small metallic mold, the rib 19 can be manufactured at a low cost. Additionally, the accuracy of the rib 19 itself is sufficiently increased. The height of the key support 15 is determined by the height of the rear end of the flat portion 12 of the chassis 11, i.e. the interval between the upper flange portion 21*c* and the lower flange portion 22 of the rib 19. Therefore, by increasing the accuracy of the rib 19, the accuracy in height of the key support 15 is also increased.

(2) The leg portion 13 of the chassis 11 according to the embodiment is a reinforcement member extended in the key arrangement direction. Since the front end of the rib 19 is fixed to the leg portion 13, even if an obliquely downward force is applied from above to the chassis 11, the chassis 11 is not easily deformed, and its accuracy is not deviated.

(3) In the embodiment, the simulating string striking portion 58 of the hammer 50 is behind the rear end of the flat portion 12 of the chassis 11. The wippen 30 is passed from under the key 14 through the open space 39 between the rear end of the chassis 11 and the key bed 2 for transmitting action of the key 14 via the jack 44 to the hammer 50. In the prior art, since the space between the rear end of the chassis and the key bed is closed, a hole for passing the wippen 30 or another action transmitting member needs to be provided in each hammer. Since the hole is not required in the embodiment, the manufacture cost can be advantageously reduced. Also, the key 14 and the action mechanism including the hammer 50 can be assembled using the open space 39, thereby providing superior operation efficiency.

In the electronic keyboard instrument according to the embodiment, since a musical sound is transmitted in accordance with the key depression timing detected by the key depression detecting sensor 37 or the like, the height of the key support 15 required to be accurate. As aforementioned in the paragraph (1), however, since the accuracy in height of the key support 15 can be sufficiently increased, the requirement can be sufficiently satisfied.

(4) The wippen 30 and the hammer 50 constituting the simulating action mechanism are swingably positioned with accuracy on the chassis 11 provided with the key support 15. Specifically, the wippen 30 provided with the jack 44 is attached onto the chassis 11 via the bearing member 33 for supporting the wippen swing axis 31, and the hammer 50 is attached onto the chassis 11 via the center rail 60 provided with the bearing member 65 for supporting the hammer swing axis 51. Also, when fixing each member on the chassis 11 before disposed on the key bed 2, the key 14 is positioned relative to the wippen 30 and the hammer 50, so that when the key 14 swings, the wippen 30 swings, the jack 44 swings and moves, then the hammer 50 swings centering on the hammer swing axis 51. In this manner, the key 14, the wippen 30 and the hammer 50 are precisely positioned and fixed on the chassis 11 beforehand, to provide a key stroke and a letting-off timing in the same manner as in an acoustic piano.

Different from the prior art, an intricate operation for separately providing and positioning on the key bed the keyboard unit and the action unit is unnecessary. In the embodiment, the chassis 11 assembled with the key 14, the wippen 30, the hammer 50 and the like can be attached to the key bed 2 as it is. Mounting operation is simplified. Also, different from the prior art, an intricate operation for adjusting the height of each key and each wippen with a capstan screw is unnecessary. According to the keyboard device of the embodiment, the mounting on the key bed can be easily attained with accuracy.

(5) Since the center rail 60 is provided in the vicinity of the rear end of the key 14 on the chassis 11, the depth dimension of the keyboard device 1 can be shortened and the entire device can be made compact.

(6) Since the wippen 30 is swingably supported by the underside of the key 14 on the chassis 11, a load on the center rail 60 can be reduced as compared with the case where the wippen is swingably supported on the center rail 60 (refer to the third embodiment described later).

(7) Since the key depression detecting sensor 37 for detecting key depression information in response to swinging of the key 14 is fixed via the base 28 onto the chassis 11 before being mounted on the key bed 2, the key 14 and the key depression detecting sensor 37 need not to be positioned on the key bed 2. Therefore, the mounting on the key bed 2 can further be simplified.

(8) The bearing 16 for supporting the key support 15 is prevented from being disengaged from the holes 17 in the chassis 17 by using the center rail 60, without providing separate components for fixing the bearing 16. Therefore, as compared with the case where the separate components are used, a component cost can be reduced. By mounting the center rail 60, the bearing 16 can be advantageously prevented from being disengaged without attaching the separate components, thereby enhancing operation efficiency.

(9) The bearing 16 is engaged in the chassis 11 by holding the peripheral portion of the holes 17 between the underside of the bearing 16 and the L-shaped legs 18. Before the center rail 60 is fixed, the bearing 16 can be temporarily fixed in the holes 17 of the chassis 11. Therefore, operation efficiency is enhanced. Also, the bearing 16 can be fixed relative to the chassis 11 without vertically oscillating. Also, since a pair of L-shaped legs 18 are provided in the key back-to-forth direction, the bearing 16 is prevented from tilting.

(10) Since the center rail 60 for supporting the hammer swing axis 51 is usually attached behind the key 14, in the embodiment the bearing 16 is easily fixed by providing the key support 15 on the rear end of the key 14, instead of providing the key support 15 around the middle of the key 14.

(11) When the key 14 needs to be replaced, in the embodiment the screw 8 and the center rail 60 need not to be removed to disengage the bearing 16 from the chassis 11. Specifically, the screw 8 is loosened, and the center rail 60 is slid rearward along the elongated hole 61*a*, so that the bearing 16 can be detached from the holes 17 in the chassis 11. The efficiency of operation for disassembling the key 14 is remarkably enhanced.

(12) The wippen 30 and the hammer 50 constituting the simulating action mechanism is swingably positioned with accuracy and fixed onto the chassis 11 provided with the key support 15 (or onto the center rail 60 fixed to the chassis 11). When assembling, the key 14, the wippen 30 and the hammer 50 are precisely positioned for providing a positional relationship among these components, to provide the same key stroke as in an acoustic piano. Therefore, different from the prior art, an intricate operation for separately providing and positioning the keyboard unit and the action unit on the key bed is unnecessary. In the embodiment the chassis 11 provided with the key 14, the wippen 30, the hammer 50 and the like can be mounted on the key bed 2 as it is. The mounting operation is remarkably simplified. Also, an intricate operation for adjusting the height of each key and each wippen with a capstan screw is unnecessary. According to the keyboard device of the embodiment, the mounting on the key bed can be easily attained with accuracy.

(13) The regulating felt 66 for regulating action of the jack 44 during acting and the hammer cushion 68 for regulating the initial position of the hammer 50 are provided on the upper face and the lower face of the rail 67, respectively. Cost can be advantageously reduced, as compared with the case where the felt and the cushion are provided on separate members.

(14) In the embodiment, the thickness of the regulating felt 66 is determined by considering the letting-off timing, while the thickness of the hammer cushion 68 is determined by considering the initial position of the hammer. When attaching the rail 67 provided with the regulating felt 66 and the hammer cushion 68 to the center rail 60, by increasing the attachment accuracy, the accuracy required for both the members 66 and 68 can be satisfied. Attachment operation is advantageously simplified as compared with the case where both the members 66 and 68 are separately attached. Also, since the rail 67 has a simple constitution, the attachment accuracy can be easily increased.

(15) On the chassis 11 for supporting the key support 15, the wippen 30 is directly provided, and the hammer 50 and the rail 67 are provided via the center rail 60. Specifically, the simulating action mechanism and the keyboard are both provided on the chassis 11. By positioning and fixing the simulating action mechanism and the keyboard with accuracy on the chassis 11 beforehand, an intricate operation for positioning the simulating action mechanism and the keyboard on the key bed 2 is unnecessary. The mounting on the key bed 2 is remarkably simplified.

(16) The hammer 50 and the rail 67 are provided on the center rail 60 fixed on the chassis 11. Therefore, the hammer cushion 68 provided on the rail 67 can be easily aligned with the hammer 50, and the initial position of the hammer 50 can be easily determined.

(17) The stop rail portion 63 is provided on the center rail 60, thereby obviating the necessity of another member. Therefore, cost can be saved. Additionally, by determining the thickness of the stop felt 63*a* of the stop rail portion 63 by considering the simulating string striking position and increasing the attachment accuracy of the rail 67, the accuracy required for the three members 63, 66 and 68 can be satisfied. The attachment operation is simplified as compared with the case where the members are individually attached.

(18) The key depression detecting sensor 37 detects the on and off timings of the switches S1 and S2 as the basic information of the performance information in response to the action of the wippen 30 for realizing the characteristics peculiar to an acoustic piano. Further, an electronic control circuit (not shown) prepares the performance information including a sound velocity (i.e. sound intensity) based on the on and off timings, and controls an electronic sound source to generate a musical sound based on the performance information. Therefore, according to the embodiment, a touch of a key depressed at high speed, a loudness of a sound produced accordingly and a time lag from when the key is depressed until the sound is produced can be reproduced in the same manner as in an acoustic piano.

(19) When the key 14 is depressed from the standstill position (refer to FIG. 1) to the full-stroke position (refer to FIG. 2), the wippen 30 swings from the wippen initial position (refer to FIG. 1) corresponding to the standstill position of the key 14 to the wippen swing position (refer to FIG. 2) corresponding to the full-stroke position of the key 14. Each wippen 30 acts in response to action of each key 14. The key depression detecting sensor 37 detects whether or not the wippen 30 has passed the first and second positions predetermined between the wippen initial position and the wippen swing position. Further, the electronic control circuit (not shown) prepares sound stop information as one piece of the performance information based on the on and off timings of the key depression detecting sensor 37 for detecting the action of each wippen 30 corresponding to the action of each key 14, to stop sounding. In this manner, in addition to the sound velocity, the sound stop information can be precisely obtained based on the information detected by the key depression detecting sensor 37. Therefore, the necessity of separately providing a sensor for obtaining the velocity and a sensor for obtaining the sound stop information is obviated, thereby reducing the cost.

(20) The cushion material 56 covers the rest portion 52, the butt portion 53 and the catcher portion 54 provided on the hammer 50 in series. Different from the case where the portions are individually covered, the cushion material doesn't to be cut and placed individually. As a result, the cost can be reduced. According to the embodiment, an impact noise can be prevented from being generated in the simulating action mechanism at a low cost.

(21) The hammer 50 is provided with the rest portion 52, the butt portion 53 and the catcher portion 54 on a continuous plane by molding. Therefore, the operation efficiency is enhanced when covering the portions continuously with the cushion material 56.

In the embodiment, since the hammer cushion 68 itself has a function of absorbing impact, the rest portion 52 of the hammer 50 is not necessarily covered with the cushion material 56. However, the rest portion 52 of the hammer 50 is formed into a flat face and the butt portion 53 and the catcher portion 54 are formed into a curved face by molding. When placing the cushion material 56, first one end of the cushion material 56 is positioned and attached to the rest portion 52 formed into a flat face, then positioned and attached to the butt portion 53 and the catcher 54. In this manner, the cushion material 56 can be preferably placed without being deviated.

(22) By using the constitution in which the sliding tape 32 of the wippen 30 is depressed by the actuator 35 provided on the underside of the key 14 before the key support 15, the key 14 does not require the portion behind the key support 15. Therefore, by cutting away the portion behind the key support 15, the length of the keyboard device 1 in the depth direction is shortened accordingly, and the entire device can be advantageously made compact.

(23) The wippen swing axis 31 is disposed between the key support 15 of the key 14 and the sliding tape 32 of the wippen 30, i.e. before the key support 15. Therefore, no space for providing the wippen swing axis 31 is required behind the key support 15. The entire device can be advantageously made compact accordingly.

Second Embodiment

Figure 3:
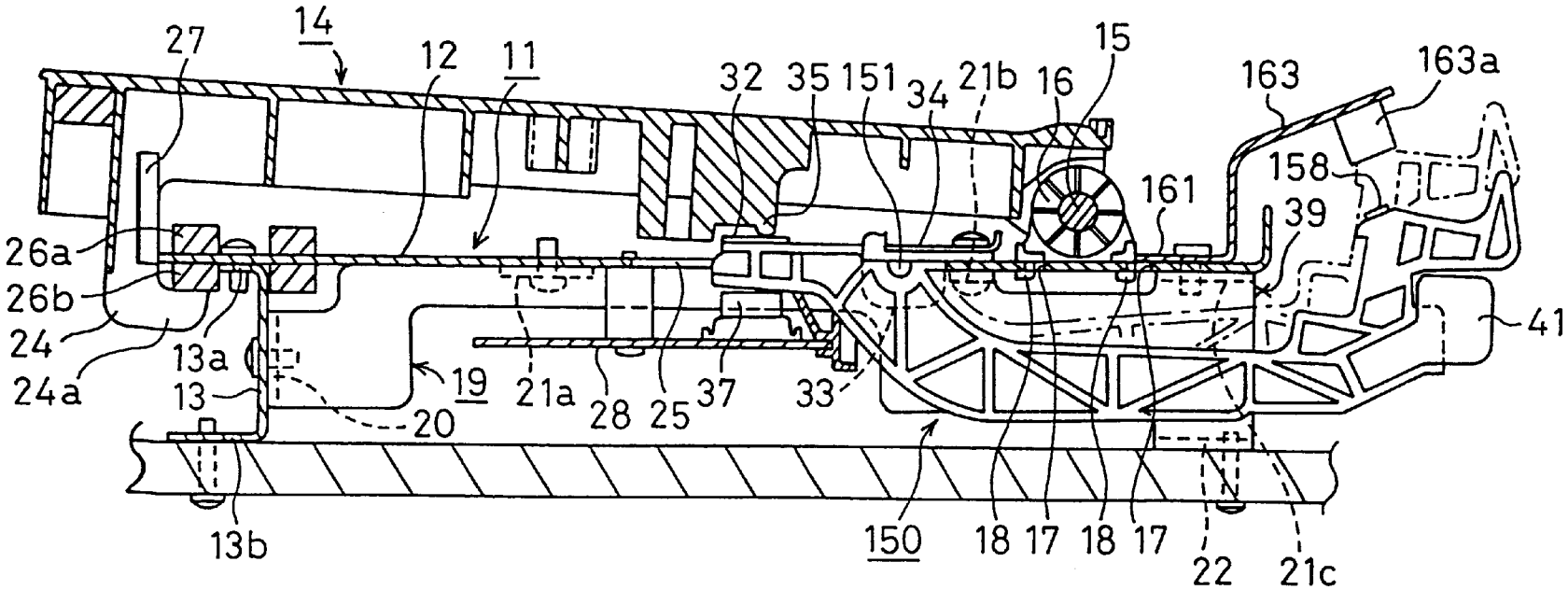
FIG. 3 is a sectional view showing a keyboard device of a second embodiment.

FIG. 3 is a sectional view of a keyboard device according to a second embodiment. In FIG. 3, a solid line shows a key release condition, while a dotted line shows a simulating string striking condition. The second embodiment is the same as the first embodiment, except that the wippen 30 of the first embodiment is used as a hammer and the center rail 60 is used only as a stop rail. Alike constitutional elements are denoted with the same reference codes and the description thereof is omitted.

A hammer 150 of the second embodiment (the action transmitting member of the invention) has substantially the same constitution of the wippen 30 of the first embodiment. The hammer 150 is swingable centering on a hammer swing axis 151, and has on its top face a simulating string striking portion 158 with a cushion material placed thereon. A flange portion 161 of a stop rail 163 is fixed with a screw on the flat portion 12 of the chassis 11. The front end of the flange portion 161 is fixed abutting on the rear L-shaped leg 18, so that the rear L-shaped leg 18 of the bearing 16 for supporting the key support 15 of the key 14 is prevented from sliding in the corresponding hole 17. Further, the stop rail 163 is provided with a stop felt 163*a* extending in the key arrangement direction.

In the keyboard device, when the key 14 is depressed, the key 14 swings counterclockwise centering on the key support 15 in FIG. 3. Thereby, the front end of the hammer 150 is depressed by the actuator 35, and the hammer 150 swings counterclockwise centering on the hammer swing axis 151 as the key 14 swings. Then, the underside of the front end of the hammer 150 depresses the key depression detecting sensor 37, while the rear end of the hammer 150 swings upward. Subsequently, the simulating string striking portion 158 of the hammer 150 collides against the stop felt 163*a*. When the key 14 is released, the hammer 150 is swung clockwise by the weight 41, and the key 14 is accordingly returned to its original position.

Also in the second embodiment, since the chassis 11 provided with the flat portion 12 and the legs 13, and also with the rib 19 and the open space 39, the aforementioned effects in the paragraphs (1)–(3) of the first embodiment can be obtained. However, different from the first embodiment, the simulating action mechanism is not provided. The letting-off action is not attained as in an acoustic piano. A touch of an acoustic piano cannot be reproduced like the first embodiment.

Third Embodiment

Figure 4:
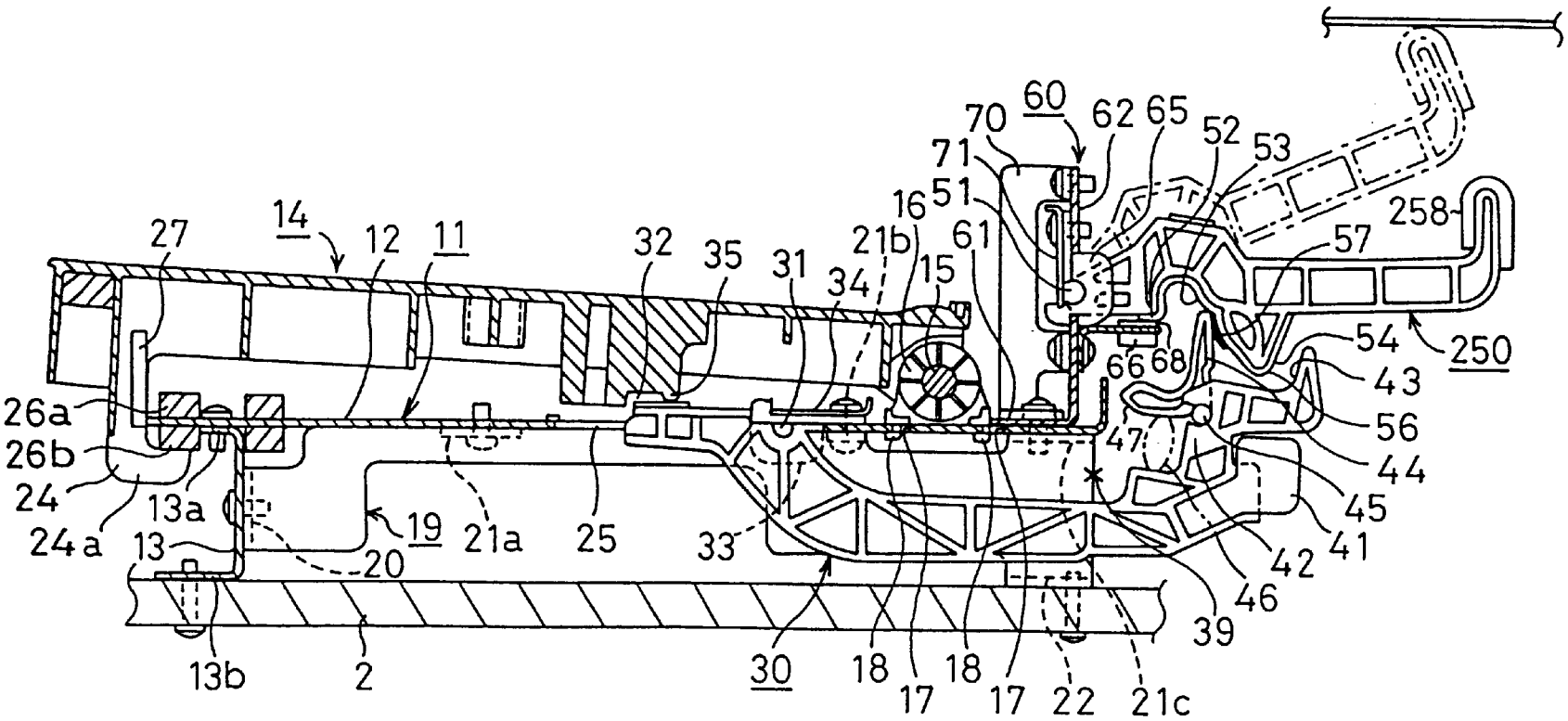
FIG. 4 is a sectional view showing a keyboard device of a third embodiment.

FIG. 4 is a sectional view of a keyboard device of a third embodiment. In FIG. 4, a solid line shows a key release condition and a dotted line shows a string striking condition. The third embodiment is a keyboard device for an acoustic piano, not a keyboard device for an electronic keyboard instrument. Therefore, different from the first embodiment, the keyboard device is not provided with the key depression detecting sensor 37 or the stop rail 63. A hammer 250 is provided with a string striking portion 258 for actually striking a string, instead of the simulating string striking portion 58. The other constitution is the same as the first embodiment. Therefore, alike constitutional elements are denoted with the same reference codes and the description thereof is omitted.

In the keyboard device, when a player depresses the key 14 until the hammer 250 rotates, the wippen 30 and the jack 44 act in the same manner as in the first embodiment. However, different from the first embodiment, after the letting-off action, a hammer felt placed on the string striking portion 258 of the hammer 250 actually strikes a string. After the hammer 250 swings back, each action element acts in the same manner as in the first embodiment.

Also in the third embodiment, since the chassis 11 is provided with the flat portion 12 and the leg potion 13, and also with the rib 19 and the open space 39, the aforementioned effects (1)–(3) of the first embodiment are obtained.

In the same manner as the first embodiment, in the third embodiment, by molding the hammer 250, the rest portion 52, the butt portion 53 and the catcher portion 54 are provided on a continuous plane and are continuously covered with the cushion material 56. Therefore, the aforementioned effects (20) and (21) of the first embodiment can be obtained.

Fourth Embodiment

Figure 7:
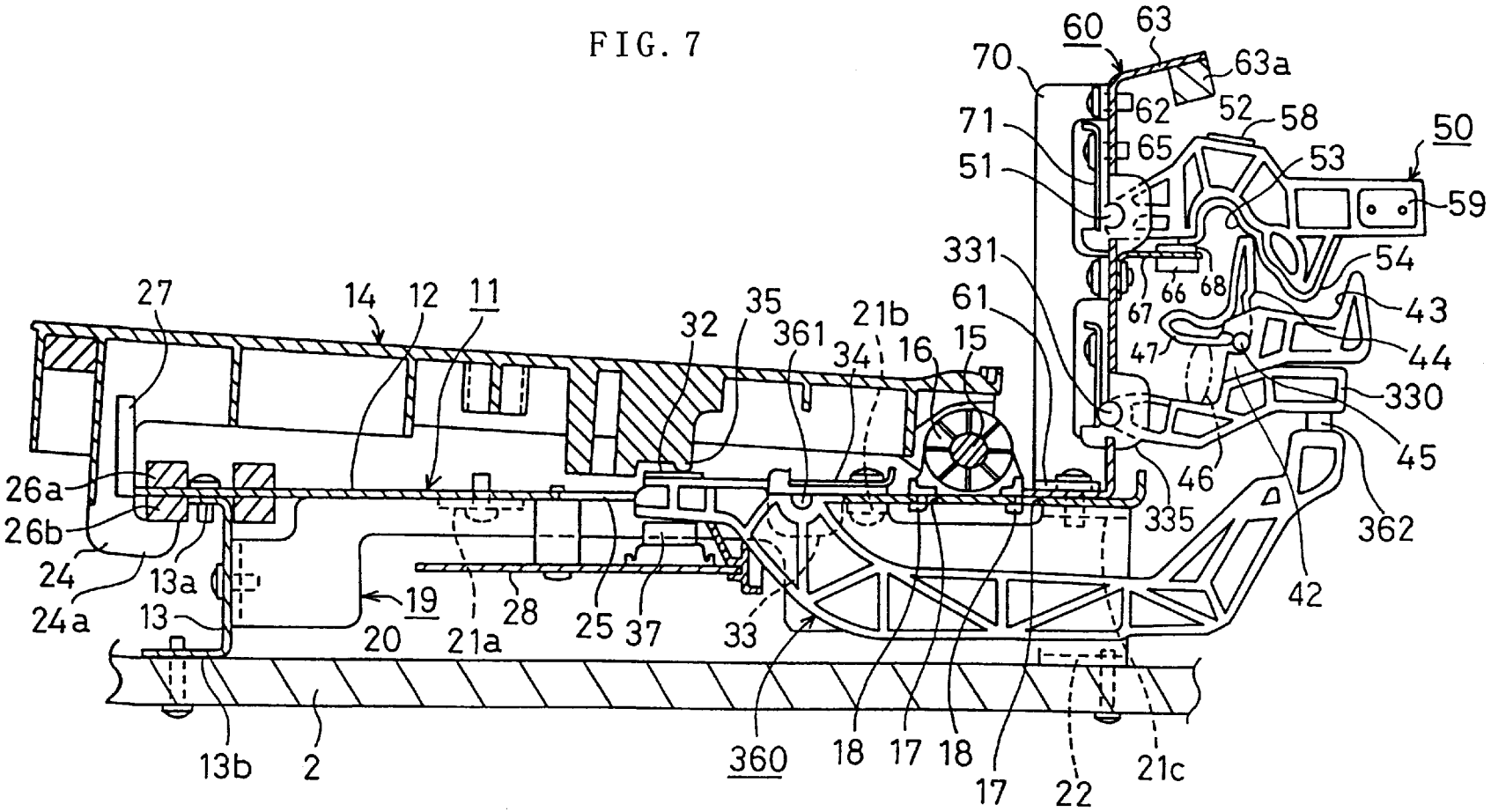
FIG. 7 is a sectional view showing a keyboard device of a fourth embodiment.

FIG. 7 is a sectional view of a keyboard device according to a fourth embodiment. In the same manner as the first embodiment, the fourth embodiment is applied to an electronic keyboard instrument. The fourth embodiment is different from the first embodiment, in that the wippen is not attached directly to the chassis, and is attached to the center rail. The same elements as those of the first embodiment are denoted with the same reference codes and the description thereof is omitted. Although an action lever 360 is similar to the wippen 30 of the first embodiment, the action lever 360 functions differently.

A wippen 330 of the fourth embodiment has a wippen swing axis 331 on its front end. The wippen swing axis 331 is swingably supported in the same manner as the hammer 50, by a substantially U-shaped bearing member 335 inserted in a square hole in the rising portion 62 of the center rail 60. The bearing member 335 is precisely positioned and attached onto the center rail 60.

The wippen 330 is provided with the bearing portion 42 for supporting the jack rotation axis 45 and the back check 43 for receiving the swung back hammer 50, which are integrally formed with accuracy. The jack tail 47 of the jack 44 is connected with the wippen 330 via the compression coil spring 46.

The front end of the action lever 360 has a lever swing axis 361 supported via the bearing member 33 on the chassis 11 in the same manner as the wippen 30 of the first embodiment. Also, below the front end of the action lever 360, the key depression detecting sensor 37 is provided in the same manner as the first embodiment. The rear end of the action lever 360 is provided with a push button 362 for abutting on the underside of the wippen 330.

In the keyboard device, when the key 14 is depressed, the key 14 swings centering on the key support 15 counterclockwise in FIG. 7. Thereby, the front end of the action lever 360 is depressed by the actuator 35, the action lever 360 swings centering on the lever swing axis 361 counterclockwise, the underside of the front end of the action lever 360 depresses the key depression detecting sensor 37, and the rear end of the action lever 360 swings upward. Then, the wippen 330 swingably supported by the center rail 60 swings counterclockwise. Subsequently, the jack 44 and the hammer 50 act in the same manner as in the first embodiment, therefore further description is omitted.

The wippen 330 and the hammer 50 constituting the simulating action mechanism of the fourth embodiment are swingably positioned and attached with accuracy on the chassis 11. The wippen 330 and the hammer 50 are both attached via the center rail 60 to the chassis 11. When attaching, the key 14, the action lever 360, the wippen 330 and the hammer 50 are precisely positioned, so as to provide a positional relationship thereamong for reproducing a key stroke of an acoustic piano.

According to the fourth embodiment, the aforementioned effects (4), (5) and (7) of the first embodiment are provided.

Fifth Embodiment

Figure 12:
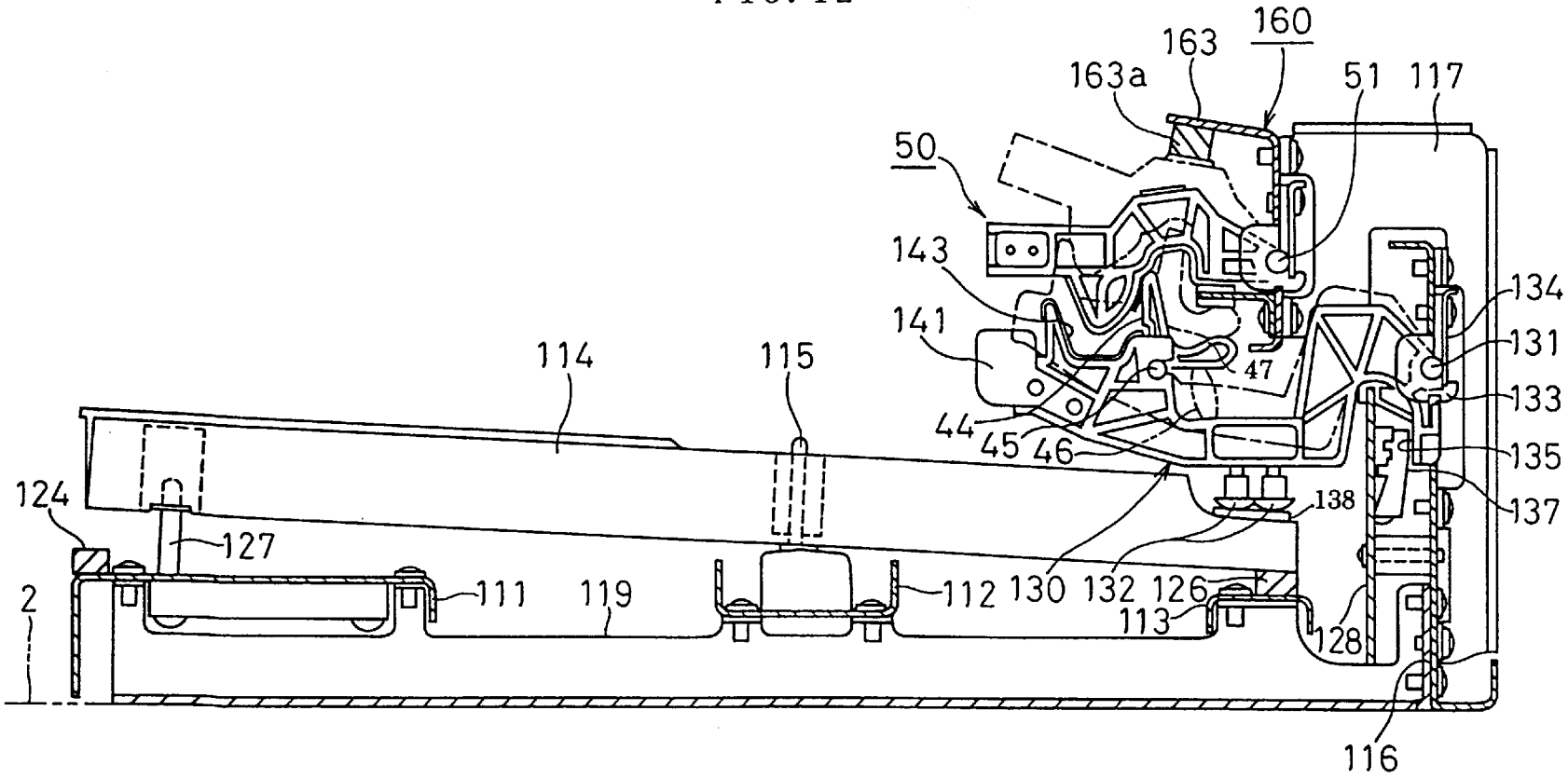
FIG. 12 is a sectional view showing a keyboard device of a fifth embodiment.
Figure 13:
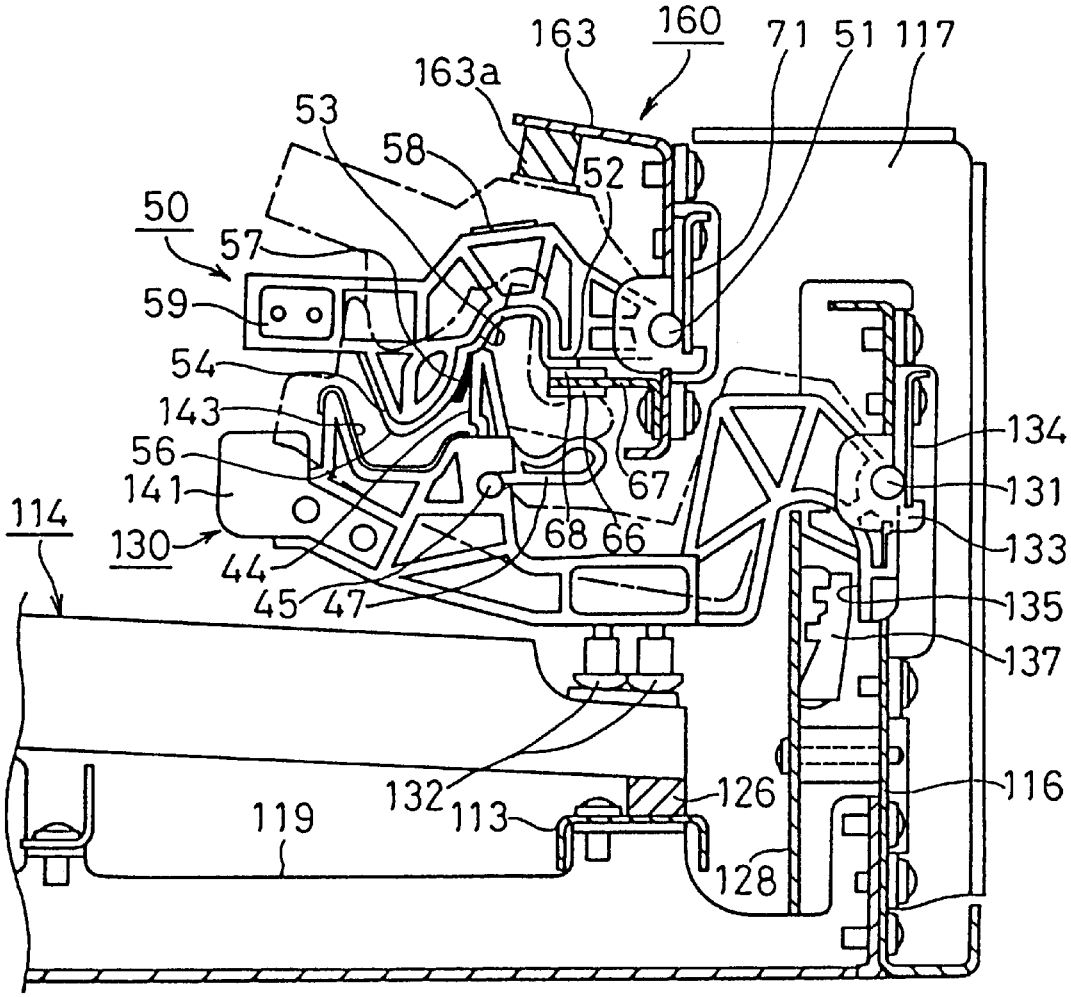
FIG. 13 is a partial enlarged view of FIG. 12.

FIG. 12 is a sectional view of a keyboard device according to a fifth embodiment. In FIG. 12, a solid line shows a key release condition and a dotted line shows a simulating string striking condition. FIG. 13 is a partial enlarged view of FIG. 12. FIGS. 12 and 13 show a white key. A black key is the same as the white key except the structure of the key itself.

In the keyboard device of the fifth embodiment, a chassis comprises of three members: a chassis front member 111; a chassis intermediate member 112 and a chassis rear member 113. The members 111–113 are supported with predetermined heights by a rib 119 mounted on the top face of the key bed 2, respectively. The rib 119 is extended in the key back-to-forth direction (in the right-to-left direction in FIG. 12, the same in the following). The chassis front member 111 is provided with a cushion 124 for abutting on the underside of the front end of a wooden key 114, and a key guide portion 127 inserted in a hollow portion in the front end of the key 114. On the chassis intermediate member 112, a balance pin 115 is built for the key 114. The key 114 can swing centering on the balance pin 115. The chassis rear member 113 is provided with a cushion 126 for abutting on the underside of the rear end of the key 114.

On the rear end of the rib 119, a vertical rail 116 is fixed with a screw and extended substantially vertical to the key bed 2 and in the key arrangement direction (perpendicular to a sheet face of FIG. 12, the same in the following). A center rail 160 is fixed with a screw and connected via a connecting rib 117 to the vertical rail 116.

On the vertical rail 116, a wippen swing axis 131 of a wippen 130 is swingably supported by a substantially U-shaped bearing member 133 inserted in a square hole in the vertical rail 116. The bearing member 133 is provided with a bearing member fixing plate 134 for covering the wippen swing axis 131. The bearing member fixing plate 134 and the bearing member 133 are fixed with the same screw to the vertical rail 116 like cantilevers. The wippen swing axis 131 is prevented by the bearing member fixing plate 134 from being disengaged from the bearing member 133. The bearing member 133 is precisely positioned and attached onto the vertical rail 116. The underside of the rear end of the wippen 130 is provided with two capstan buttons 132 for abutting on the top face of the rear end of the key 114.

Behind the key 114, a base 128 is disposed substantially parallel with the vertical rail 116. On the base 128, a key depression detecting sensor 137 is provided opposed to a depressing portion 135 of the wippen 130. The key depression detecting sensor 137 has substantially the same function as that of the key depression detecting sensor 37 of the first embodiment, and is precisely positioned on the base 128 by considering the positional relationship with the key 114 and the wippen 130.

On the front end of the wippen 130, a balancing weight 141 is provided, the jack rotation axis 45 of the jack 44 (the same as that of the first embodiment) is supported, and a back check 143 is provided for receiving the swung back hammer 50 (the same as that of the first embodiment). The jack tail 47 of the jack 44 is connected via the compression coil spring 46 (see FIG. 12) to the wippen 130 in the same manner as the first embodiment.

The center rail 160 fixed to the connecting rib 117 is extended substantially vertical to the key bed 2 and in the key arrangement direction. The center rail 160 is provided with a stop rail portion 163 extending up obliquely forward. On the underside of the stop rail portion 163 is placed a stop felt 163*a*.

As shown in FIG. 13, the substantially L-shaped rail 67 is fixed with a screw to the center rail 160 below the hammer swing axis 51 in the same manner as in the first embodiment. The rail 67 has the hammer cushion 68 on its top face and the regulating felt 66 on its underside in the same manner as in the first embodiment. The hammer 50 has the same constitution as that of the first embodiment. In the same manner as in the first embodiment, the hammer swing axis 51 is swingably supported by the center rail 160. Each element of the hammer 50 is the same as that of the first embodiment, and denoted with the same reference codes, therefore further description is omitted.

In the keyboard device of the fifth embodiment having the aforementioned constitution, when the key is not depressed, as shown in FIG. 12, the weight 141 on the front end of the wippen 130 and the like exert a force in the counterclockwise direction in FIG. 12. The force is applied to the rear end of the key 114, whose front end tries to swing upward.

However, since the underside of the rear end of the key 114 abuts on the cushion 126, the key 114 is inhibited from swinging.

When a player depresses the key 114, the key 114 swings centering on the balance pin 115 provided substantially on the middle of the key 114 counterclockwise in FIG. 12. Thereby, the wippen 130 is depressed via the capstan buttons 132, and swings centering on the wippen swing axis 131 clockwise. When the depressing portion 135 depresses the key depression detecting sensor 137, the front end of the wippen 130 swings upward. Then, the jack 44 accompanies the swinging wippen 130, rises to push up the butt portion 53 of the hammer 50 and swings clockwise relative to the wippen 130. The subsequent action is the same as in the first embodiment, except that the rotation direction of the jack and the hammer in FIG. 12 is in reverse to the rotation direction of the first embodiment shown in FIGS. 1 and 2. Further description is therefore omitted.

The action when a player depresses the key 114 at high speed is now described. When depressed at high speed, the key 114 swings centering on the balance pin 115 counterclockwise in FIG. 12. Thereby, the capstan buttons 132 of the wippen 130 are depressed by a cushion 138 placed on the key 114. Since the wippen 130 has a large inertial moment, the cushion 138 is resiliently deformed and the wippen 130 itself is slightly deformed to store pressure. Therefore, the wippen 130 does not immediately start swinging.

Subsequently, in addition to the force for pushing up the capstan buttons 132 of the wippen 130, the restoring force of the deformed cushion 138 and the deformed wippen 130 is exerted, so that the wippen 130 starts swinging with force. Accompanying the forced swinging of the wippen 130, the jack 44, having an inertial moment smaller than that of the wippen 130, immediately swings pushing up the hammer 50. As the jack 44 swings, the hammer 50, having an inertial moment smaller than that of the wippen 130, immediately starts swinging, is let off from the jack 44 and reaches the simulating string striking position. Therefore, the characteristics peculiar to an acoustic piano, i.e. a touch of a quickly depressed key, its relationship with the loudness of a produced electronic sound and a time lag from when the key is depressed until the sound is generated can be realized by the wippen 130 in the embodiment.

The key depression detecting sensor 137 stays at its initial condition (with both the switches off), before the wippen 130 starts swinging. After the wippen 130 starts swinging with force, the switches turn on successively. Subsequently, after the hammer 50 swings back, if the key is depressed, both the switches are on. If the key is released, both the switches are off. Therefore, the sound stop information can be precisely obtained based on the on and off timings of the switches.

According to the keyboard device of the fifth embodiment, the aforementioned effects (1), (2), (13)–(17) of the first embodiment can be obtained.

Sixth Embodiment

Figure 14:
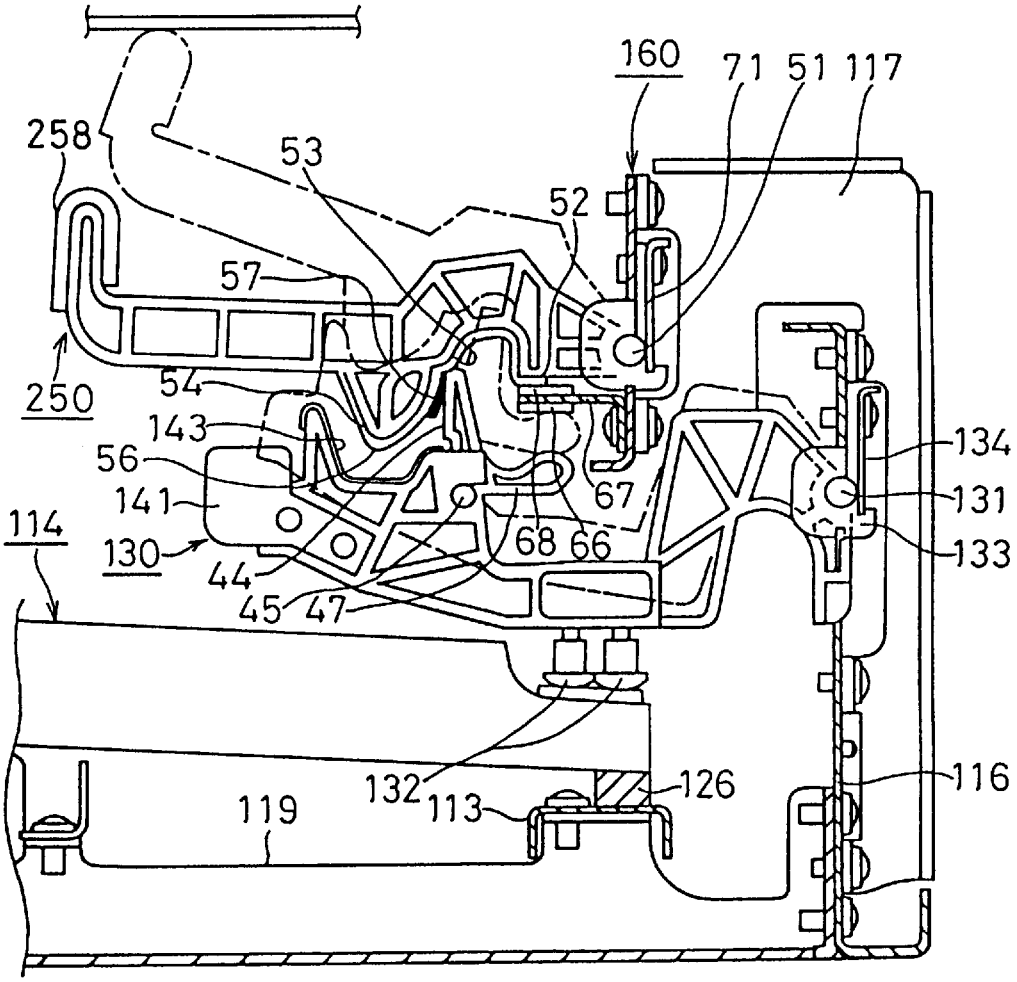
FIG. 14 is a partially enlarged sectional view showing a keyboard device of a sixth embodiment.

FIG. 14 is a partial sectional view of a keyboard device of a sixth embodiment. In FIG. 14, a solid line shows a key release condition and a dotted line shows a string striking condition. The keyboard device of the sixth embodiment is applied to an acoustic piano, not to an electronic keyboard instrument. Therefore, the sixth embodiment is different from the fifth embodiment, in that the key depression detecting sensor 137 and the stop rail portion 163 are not provided in the same manner as the third embodiment, and a hammer 250 (the same as in the third embodiment) is provided with a string striking portion 258 for actually striking a string. The other respects are the same as in the fifth embodiment, denoted with the same reference codes, therefore further description is omitted. FIG. 14 is a partial sectional view, not showing the keyboard, the chassis, the rib and the like, which have the same constitution as in the fifth embodiment.

In the keyboard device of the sixth embodiment, when a player depresses the key 114, each action member (the wippen 130 and the jack 44) acts in the same manner as in the fifth embodiment, until the hammer 250 rotates. After the letting-off action, a hammer felt placed on the string striking portion 258 of the hammer 250 actually strikes a string. After the hammer 250 swings back, each action element acts in the same manner as in the fifth embodiment. According to the sixth embodiment, the aforementioned effects (13)–(16) can be obtained.

Seventh Embodiment

Figure 17:
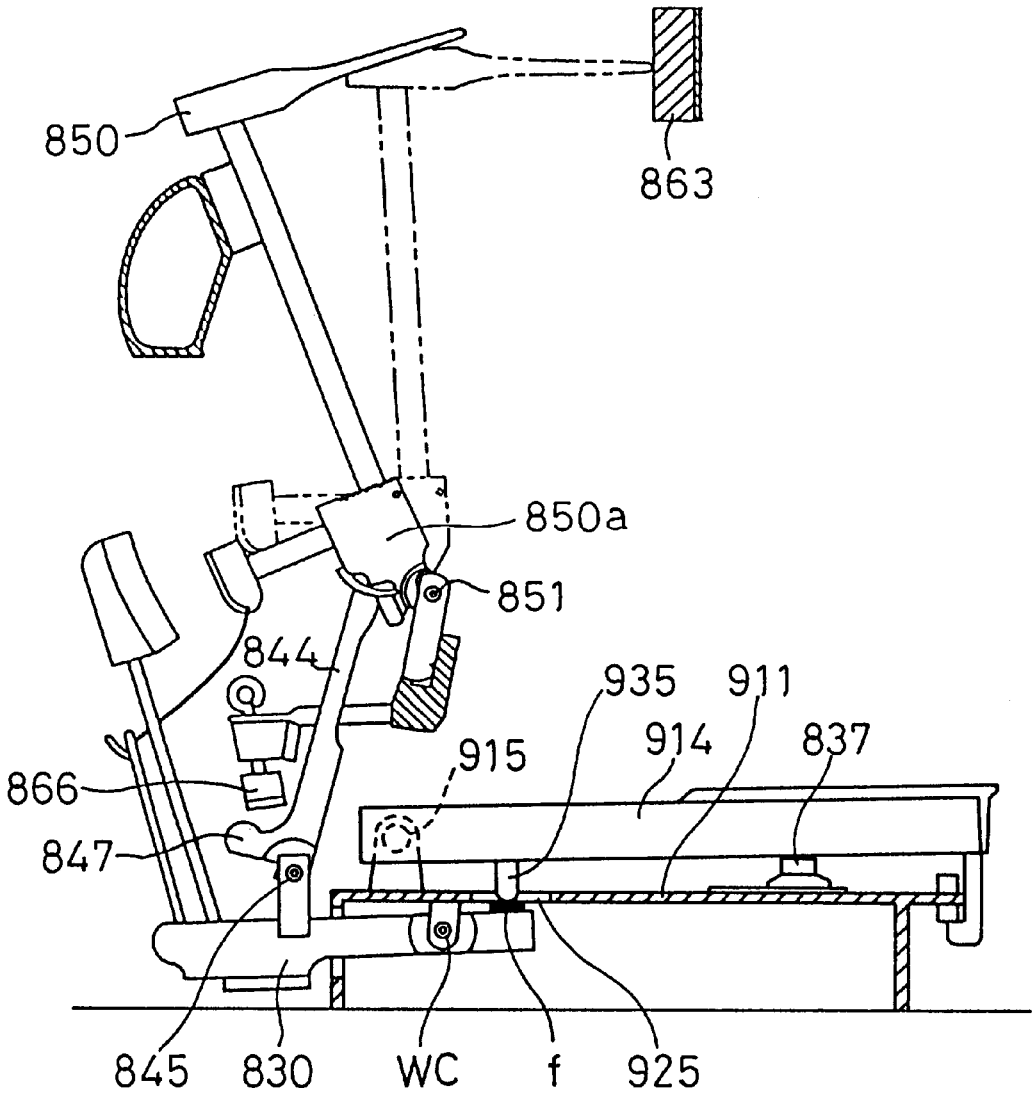
FIG. 17 is a sectional view of a keyboard device of a seventh embodiment.

FIG. 17 is a sectional view of a keyboard device according to a seventh embodiment. In FIG. 17, a solid line shows a key release condition and a two-dotted line shows a string striking condition.

Figure 8:
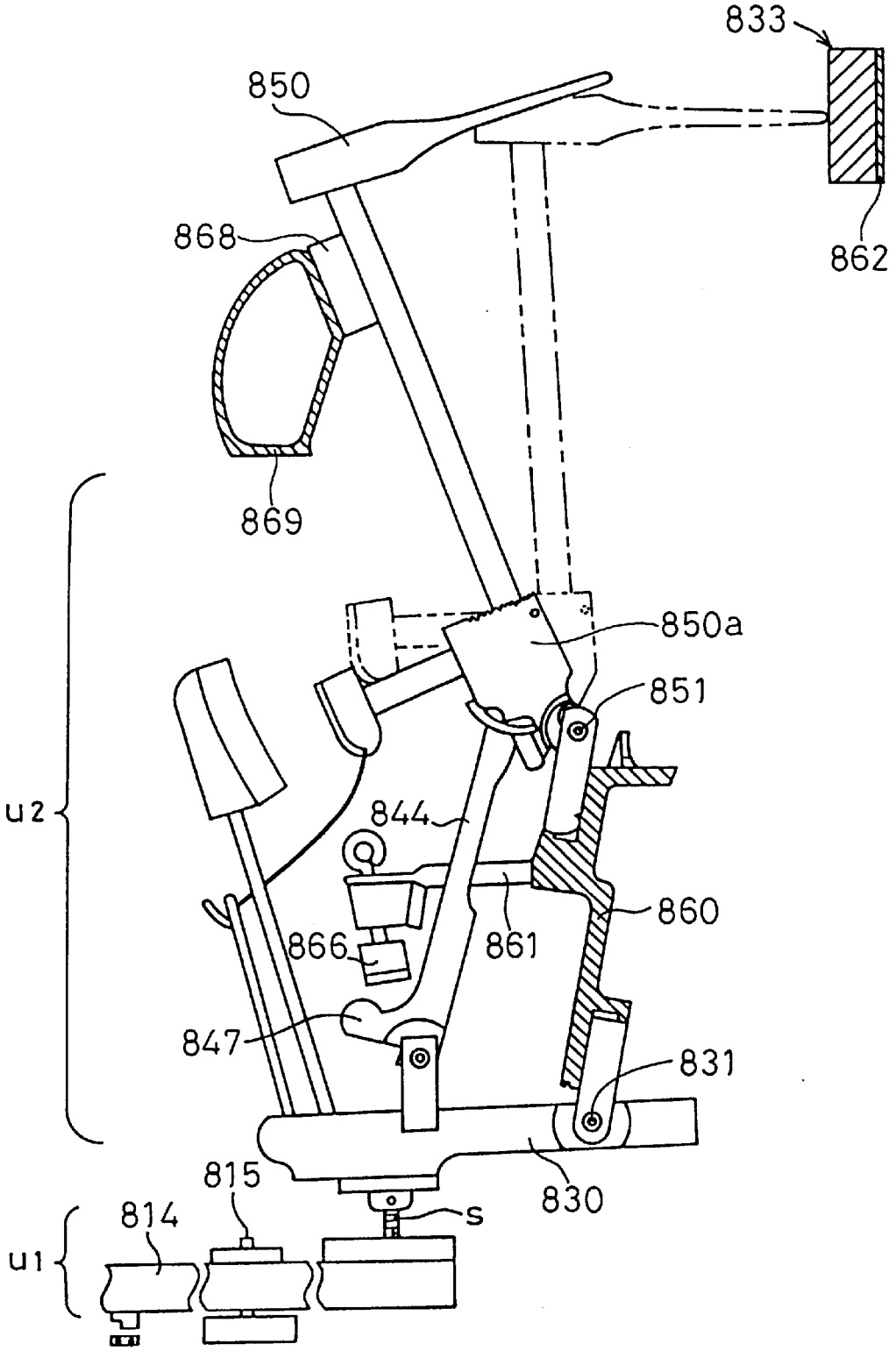
FIG. 8 PRIOR ART
FIG. 8 is a sectional view of a prior-art keyboard device.

The keyboard device of the seventh embodiment is provided with the action mechanism of the prior-art keyboard device of FIG. 8: the wippen 830, the jack 844, the hammer 850 and the hammer stopper 863.

A key support 915 of a key 914 is supported by a bearing fixed on a chassis 911. The key 914 has the portion behind the key support 915 cut away. On the underside of the key 914 before the key support 915, an actuator 935 abuts via an opening 925 in the chassis 911 on a felt f or depressed portion of the wippen 830. Also below the key 914 disposed is a key depression detecting sensor 837.

A wippen axis WC of the wippen 830 is supported before the key support 915 under the chassis 911. The wippen 830 has the felt f on its front end and a jack axis 845 on its rear end. The wippen axis WC is positioned between the felt f and the key support 915.

The operation of the keyboard device according to the seventh embodiment is briefly described. When the key 914 is depressed, the actuator 935 provided on the underside of the key 914 depresses the felt f of the wippen 830. Then, the wippen 830 swings centering on the wippen axis WC clockwise in FIG. 17, and the jack 844 supported by the jack axis 845 of the wippen 830 pushes up the butt 850*a* of the hammer 850. The hammer 850 starts swinging centering on the hammer axis 851 clockwise. After the jack tail 847 abuts on the regulating felt 866, the jack 844 immediately swings counterclockwise and moves apart (lets off) from the butt 850*a*. Then, the hammer 850 starts inertial movement. Subsequently, the hammer 850 collides against the hammer stopper 863 (as shown by a two-dotted line in FIG. 17), and swings back.

In the keyboard device of the seventh embodiment, the configuration of the key 914 is the same as that of the first embodiment. The positional relationship of the key support 915 of the key 914 with the felt f or depressed portion of the wippen 830, the wippen axis WC and the jack axis 845 is the same as in the first embodiment. Therefore, the aforementioned effects (18) and (19) of the first embodiment can be obtained.

Other Embodiments

Figure 5:
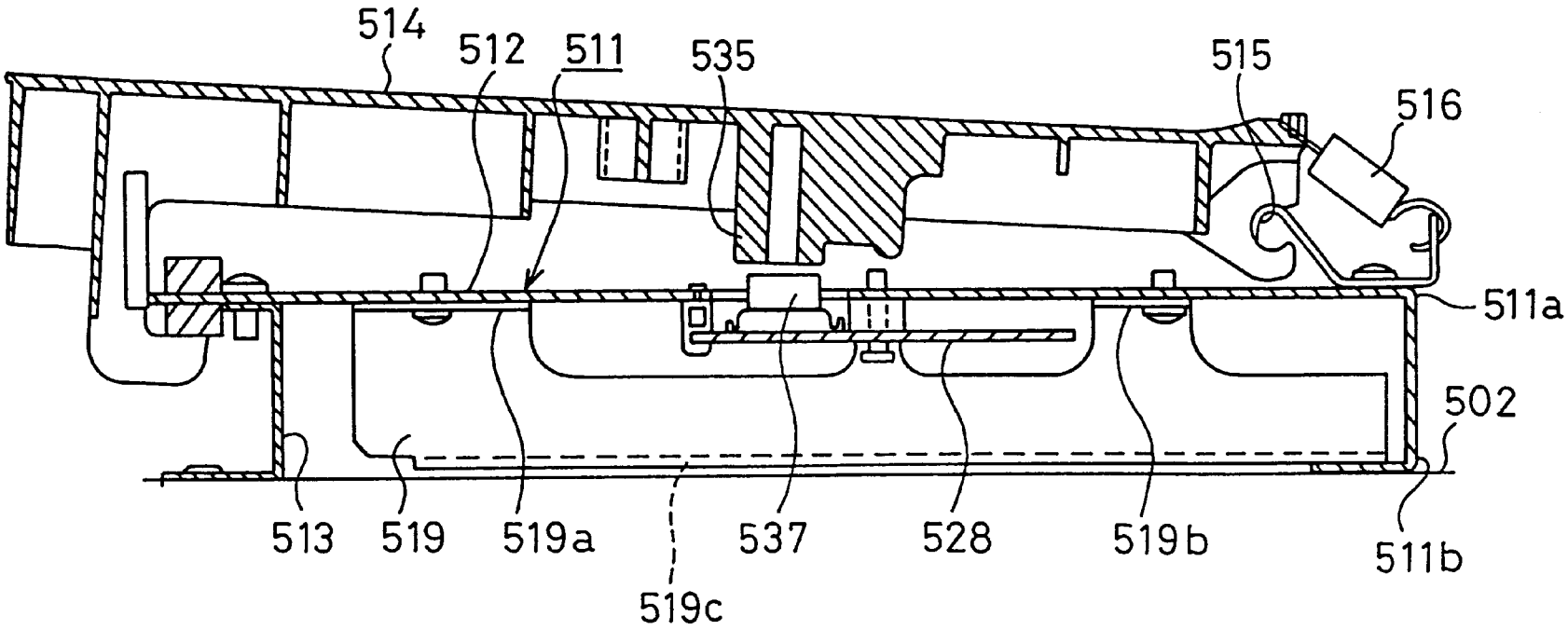
FIG. 5 PRIOR ART
FIG. 5 is a sectional view showing a prior-art keyboard device.
Figure 6:
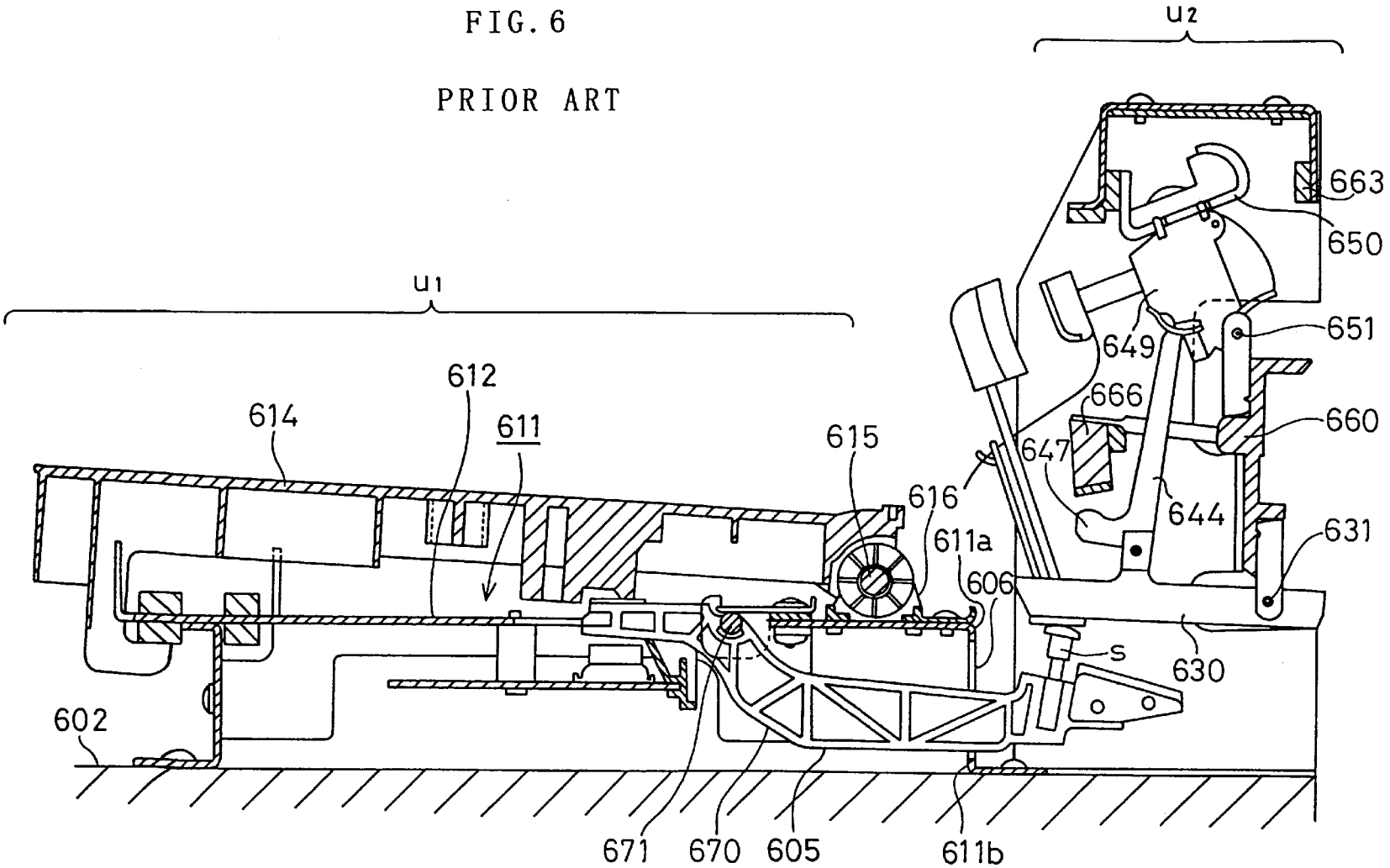
FIG. 6 PRIOR ART
FIG. 6 is a sectional view of a prior art keyboard device provided with a simulating action mechanism.

The constitution of the chassis 11 and the rib 19 can be applied, for example, to the keyboard device of FIG. 5 or FIG. 6. In either case, the aforementioned effects (1)–(3) of the first embodiment can be obtained. When the constitution is applied to the keyboard device of FIG. 5, however, the aforementioned effects (1) and (2) of the first embodiment can be provided, but the effect (3) is not provided, because the hammer is not provided.

Also in each of the aforementioned embodiments, the chassis is, for example, divided into a chassis front member (provided with longitudinal felts 26*a* and 26*b*) and a chassis rear member (provided with the bearing 16). The chassis members are interconnected with the rib 19. In this case, the effects similar to those of the first embodiment can be obtained.

Also in the aforementioned embodiments, the inertial moment of the wippen 30 or 130 may be designed larger than the inertial moment of the key 14 or 114. The released key 14 or 114 is given a force by the wippen 30 or 130 receiving the weight of the hammer 50 and the like, so that the front end of the key rotates upward. Thereby, the key is held at its standstill position. In this case, when the wippen 30 or 130 has a larger inertial moment than the key 14 or 114, the key 14 or 114 can be effectively held at its standstill position only by the wippen 30 or 130, even when the jack 44 and the hammer 50 have a compact structure and a remarkably small inertial moment.

Further in the aforementioned embodiments, the key depression detecting sensor 37 or 137 uses contact type button switches. Alternatively, a contact type leaf switch or a non-contact type photo switch can be used. Here, the leaf switch has a movable contact point formed of a spring plate between two opposed fixed contact points. The movable contact point is usually in contact with one of the fixed contact points (used as the first switch S1), and is placed by external force in contact with the other fixed contact point (used as the second switch S2). When the external force is eliminated, the movable contact point is again in contact with the first fixed contact point. The photo switch is formed by providing a light emitting element (e.g. an infrared emission diode) on one of its two opposed faces and a light receiving element (e.g. a photo transistor) on the other face. Two pairs of such elements are provided, and a light path is formed between each light emitting element and each light receiving element. The photo switch is a photo interrupter for detecting whether the light is interrupted or transmitted in the light path. Light is interrupted or transmitted in the light path by a stepped shutter.

In the aforementioned embodiments, the key 14, 114 or 914 has the portion behind the key support 15, 115 or 915 cut away or removed. The portion behind the key support 15, 115 or 915 can be remained by an appropriate length as required.

What is claimed is:

1. A keyboard device comprising:

a chassis positioned higher than a top face of a key bed and having a key support for swingably supporting a key; and a plurality of ribs arrayed along a key arrangement direction for reinforcing the chassis and extending in a key back-to-front direction; and said ribs fixing a predetermined interval between said key support on said chassis and said key bed.

2. The keyboard device according to claim 1, wherein each of said ribs is a metallic plate having a first contact face supporting said key support on said chassis and a second contact face in contact with said key bed, said first contact face and said second contact face having been formed by bending said metallic plate.

3. The keyboard device according to claim 1, wherein a reinforcing member is integrally formed on said chassis and extends in the key arrangement direction, and wherein said ribs are fixed to said reinforcing member.

4. The keyboard device according to claim 1 wherein the keyboard device has an open space between a rear end of said chassis and said key bed, and said keyboard further comprises:

one of a string striking portion and a simulating string striking portion disposed behind said rear end of said chassis; and an action transmitting member passing from an underside of said key through said open space to one of said string striking portion and said simulating string striking portion, for transmitting action of said key to one of said string striking portion and said simulating string striking portion.

5. The keyboard device according to claim 1, wherein said keyboard device further comprises at least one key depression detecting sensor disposed proximate the key for determining key depression information, the at least one sensor being electrically connected to an electronic control circuit for providing electronic sound in accordance with key depression information.

6. A keyboard device having a key support as a swing center of a key on a chassis, said keyboard device comprising:

a wippen swingably supported by said chassis for swinging in conjunction with said key;

a jack swingably supported by said wippen for swinging and moving in conjunction with said wippen; and a rail member attached to said chassis for swingably supporting a hammer wherein said hammer swings in conjunction with said jack.

7. The keyboard device according to claim 6, wherein said rail member is disposed proximate a rear end of said key on said chassis.

8. The keyboard device according to claim 6 or 7, wherein said wippen is swingably supported by an underside of said key on said chassis.

9. The keyboard device according to claim 6 for use with an electronic keyboard instrument, wherein a key depression detecting sensor for detecting key depression information is formed integrally on or attached to said chassis.

10. A method of assembling a keyboard device, wherein before mounting a chassis on a key bed, a key swingably supported on a key support, a wippen swingably supporting a jack, and a rail member swingably supporting a hammer are fixed to said chassis to have a predetermined positional relationship between said key, said wippen, said jack and said hammer, so that when said key swings, said wippen swings, said jack swings and moves, and said hammer swings accordingly, whereby the chassis having the affixed key support, key, wippen, jack, rail member and hammer comprises a complete modular key action unit that can be assembled independent of the key bed or a piano support structure.

11. The method of assembling the keyboard device according to claim 10, wherein said rail member is fixed in the vicinity of a rear end of said key on said chassis.

12. The method of assembling the keyboard device according to claim 10, wherein said wippen is swingably supported by the underside of said key on said chassis.

13. The method of assembling the keyboard device according to claim 10 applied to an electronic keyboard device, wherein a key depression detecting sensor for detecting key depression information in response to swinging of said key is fixed on the chassis before being mounted on said key bed.

14. A keyboard device comprising:

a key support member including a swing center of a key, said key support member being fixed on a chassis;

a rail member fixed on the chassis;

said key support member being inserted in an inlet provided in said chassis; and said rail member fixing said key support member and preventing said key support member from being disengaged from the inlet in said chassis.

15. The keyboard device according to claim 14, wherein said key support member is mounted in said inlet with clearance, while being engaged with a peripheral portion of said inlet; and said rail member fixes the key support member in said inlet.

16. The keyboard device according to claim 14, wherein said key support member is pivotally attached to the key proximate a rear end of said key.

17. The keyboard device according to claim 14, wherein said rail member is fastened with a fastening member onto said chassis via a guide slot provided in said rail member; and by loosening said fastening member, said rail member can be slid along said guide slot between a position where said key support member is prevented from being disengaged from said chassis and a position where said key support member is allowed to be disengaged from said chassis.

18. The keyboard device according to claim 14 further comprising:

a wippen swingably supported by one of said chassis and said rail member for swinging when said key swings;

a jack swingably supported by said wippen for swinging when said wippen swings; and a hammer pivotable about a hammer swing axis provided on said rail member for swinging when said jack swings and contacts the hammer, whereby when said key is depressed said wippen swings, causing the jack to swing and contact the hammer, with the hammer swinging in response.

19. A keyboard device comprising:

a wippen for swinging when a key swings;

a jack swingably supported by said wippen for swinging and moving when said wippen swings and having action regulated by a regulating member during acting; and a swingable hammer having an initial position defined by a hammer cushion member and one of a string striking position and a simulating string striking position defined by one of a string and a hammer stopper respectively, said hammer swinging when said jack swings and moves, and moving apart from said jack when said jack movement is regulated by said regulating member, said hammer further having starting inertial movement and subsequently reaching one of the string striking position and the simulating string striking position; and said regulating member and said hammer cushion member being attached to the same support member.

20. The keyboard device according to claim 19, wherein said support member has a first face and a second face, said regulating member being attached to said first face, and said hammer cushion member being attached to said second face.

21. The keyboard device according to claim 19, wherein said wippen, said hammer and said support member are attached directly or via another member to a chassis for supporting a key support of said key.

22. The keyboard device according to claim 21, wherein said hammer and said support member are attached to a rail member connected to said chassis.

23. The keyboard device according to claim 22, further comprising a hammer stopper for inhibiting the hammer from swinging at the simulating string striking position during the inertial movement.

24. A keyboard device for an electronic instrument comprising:

a wippen for swinging when a key swings;

a jack, having a regulated action, swingably supported by said wippen for swinging and moving when said wippen swings;

a hammer which starts swinging when said jack swings and moves, said hammer moving apart from said jack having said regulated action, and starting inertial movement and reaching a simulating string striking position;

an information detecting means for detecting basic performance information in response to swinging of said wippen, and said wippen having a larger inertial moment than said jack and said hammer.

25. The keyboard device according to claim 24, wherein said wippen has a larger swing radius than said jack and said hammer.

26. The keyboard device according to claim 24, wherein said key abuts on said wippen via a cushion material.

27. The keyboard device for the electronic instrument according to claim 24, wherein said wippen swings from a first position corresponding to a standstill position of said key via a second position corresponding to a full-stroke position of said key when said key is depressed from said standstill position to said full-stroke position; and said information detecting means detects that said wippen reaches one of said first position and said second position.

28. A keyboard device comprising:

a wippen for swinging when a key swings;

a jack swingably supported by said wippen for swinging and moving when said wippen swings and having such swinging and moving regulated during acting;

a hammer which starts swinging when said jack swings and moves, and moves apart from said jack when said jack swinging and moving is regulated, said hammer having a starting inertial movement and subsequently reaching one of a string striking position and a simulating string striking position;

a back check integral with or attached to the wippen for catching the hammer swinging back after reaching one of said string striking position and said simulating string striking position; and said hammer further comprising:

a butt portion on which said jack can abut;

a catcher portion for abutting said back check; and a shock absorbing member covering said butt portion and said catcher portion.

29. The keyboard device according to claim 28, wherein said butt portion and said catcher portion are disposed on a continuous face of said hammer.

30. The keyboard device according to claim 29, wherein said hammer is molded to form a unitary structure including said butt portion integral with said catcher portion.

31. The keyboard device according to claim 28 having a hammer cushion for regulating an initial position of said hammer, wherein said hammer further includes a rest portion for abutting on said hammer cushion, and said shock absorbing member continuously covers said rest portion, said butt portion and said catcher portion.

32. The keyboard device according to claim 31, wherein said butt portion, said catcher portion and said rest portion are disposed on a continuous face of said hammer.

33. The keyboard device according to claim 32, wherein said hammer is molded to form a unitary structure including said butt portion, said catcher portion and said rest portion.

34. A keyboard device comprising:

a key swingably supported by a key support;

a wippen swingably centering on a wippen axis when said key swings;

a jack swingably supported by a jack axis attached to said wippen, said jack swinging and moving when said wippen swings and said swinging and moving being regulated;

a hammer which starts swinging when said jack swings and moves, said hammer moving apart from said jack when said jack swinging and moving is regulated, said hammer having a starting inertial movement and subsequently reaching one of a string striking position and a simulating string striking position;

said wippen having a first end being depressed by an underside of said key and a second end having said jack axis which rises when said first end is depressed; and said key support for swingably supporting said key being disposed between said first end and said jack axis.

35. The keyboard device according to claim 34, wherein said key is formed with an opening behind said key support.

36. The keyboard device according to claim 34, wherein said wippen axis is disposed between said key support and said first end.

37. A method of assembling a keyboard device comprising the steps of:

providing a chassis comprising a generally rectangular planar portion having a front long edge, a rear long edge, two end short edges, a top, a bottom, and a plurality of openings arrayed between the two end short edges proximate the rear long edge;

attaching at least one leg portion to the bottom of the chassis proximate the front long edge, the at least one leg portion extending downwards for providing an area to affix the front long edge of the chassis to a key bed at a height above the key bed;

attaching a plurality of ribs underneath the chassis to at least one of the at least one leg portion and the bottom of the chassis, each rib extending substantially from the front long edge to the rear long edge, the ribs being arrayed between the two end short edges along the length of the chassis, and each rib being attachable to the key bed for affixing the rear long edge of the chassis to the key bed at a height above the key bed;

attaching to the chassis a plurality of key supports each swingably supporting a key, one of each of the key supports being attached to the top of the chassis between one of the plurality of openings and the rear long edge;

attaching a plurality of wippens to the bottom of the chassis each via a separate swingable support, one of each of the swingable supports being attached to the bottom of the chassis between one of the openings and the rear long edge, each wippen swingably supporting a jack, and each of the plurality of wippens being positioned relative to the keys so that one of the wippens swings in response to one of the keys swinging; and attaching at least one rail member to the rear long edge of the chassis, the at least one rail member swingably supporting at least one hammer, the at least one hammer being positioned relative to the wippens and jacks such that the at least one hammer swings in response to one of the wippens and jacks swinging.

38. A keyboard device comprising:

a chassis comprising a generally rectangular planar portion having a front long edge, a rear long edge, two end short edges, a top and a bottom;

a plurality of key supports each swingably supporting a key, the key supports each being attached to the top of the chassis proximate the rear long edge;

at least one leg portion attached to the bottom of the chassis proximate the front long edge and extending downwards for affixing the front long edge of the chassis to a key bed at a height above the key bed; and a plurality of ribs, each rib extending substantially from the front long edge to the rear long edge, the ribs being arrayed underneath the chassis between the two end short edges along the length of the chassis, each rib being attached to at least one of the at least one leg portion and the chassis, and each rib being attachable to the key bed for affixing the rear long edge of the chassis to the key bed at a height above the key bed.

* * * * *